US009429068B2

(12) United States Patent
Hibi et al.

(10) Patent No.: US 9,429,068 B2
(45) Date of Patent: Aug. 30, 2016

(54) ENGINE GENERATOR ASSEMBLY

(75) Inventors: Shinji Hibi, Osaka (JP); Sanping Li, Jiangsu Province (CN)

(73) Assignee: Yanmar Co., Ltd., Osaka (JP)

( * ) Notice: Subject to any disclaimer, the term of this patent is extended or adjusted under 35 U.S.C. 154(b) by 163 days.

(21) Appl. No.: 13/982,025

(22) PCT Filed: Jan. 28, 2011
(Under 37 CFR 1.47)

(86) PCT No.: PCT/CN2011/000143

§ 371 (c)(1),
(2), (4) Date: Dec. 11, 2013

(87) PCT Pub. No.: WO2012/100376

PCT Pub. Date: Aug. 2, 2012

(65) Prior Publication Data

US 2014/0209045 A1 Jul. 31, 2014

(51) Int. Cl.
*F02B 63/04* (2006.01)
*F02B 77/13* (2006.01)

(52) U.S. Cl.
CPC ..... *F02B 63/04* (2013.01); *F02B 77/13* (2013.01)

(58) Field of Classification Search
CPC ..... F02B 63/04; F02B 63/044; F02B 77/13; H02K 9/00; H02K 9/02; H02K 9/04; H02K 9/06; G10K 11/16; F01N 1/10; F01N 1/24; F01N 13/007; F01N 5/025; F01N 2510/04
USPC ..... 123/2, 3, 195 C, 195 E, 198 D; 290/1 B; 181/198, 200, 202, 204, 222, 256, 257, 181/284
See application file for complete search history.

(56) References Cited

U.S. PATENT DOCUMENTS 4,122,353 A 10/1978 Noguchi
6,039,009 A * 3/2000 Hirose ..... 123/2

(Continued)

FOREIGN PATENT DOCUMENTS

CN 201034044 Y 3/2008
CN 101436802 A 5/2009

(Continued)

OTHER PUBLICATIONS

Machine translation of Detailed Description, JP2003/090224A, Yabe et al., publ'n date Mar. 28, 2003, obtained from https://www.j-platpat.inpit.go.jp, pp. 1-14.*

(Continued)

*Primary Examiner* — Grant Moubry
(74) *Attorney, Agent, or Firm* — Sterne, Kessler, Goldstein & Fox P.L.L.C.

(57) ABSTRACT

The purpose is to provide an engine generator 1 which can reduce noise and performs cooling efficiently. In the engine generator 1 having an engine 2, a generator 3, a cover 4 and a muffler box 13, external openings 412 and 414 formed in the cover 4 for sucking outside air into the cover 4 and intake ducts 7 for introducing the air sucked via the external opening 412 and 414 into the inside of the cover 4. An opening 71 is formed in the upper side of each of the intake duct 7, and the intake duct 7 is arranged along the side surface of the muffler box 13 and below the upper surface of the muffler box 13 for a predetermined distance. A sponge 17 is provided between the upper side of the intake duct 7 and the side surface of the muffler box 13 so as to cover a part of the opening 71. An air passage 18 is formed above the intake duct 7 by the side surface of the muffler box 13 and the sponge 17.

10 Claims, 19 Drawing Sheets

(56) References Cited

U.S. PATENT DOCUMENTS

| | | | | |
|---|---|---|---|---|
| 7,430,992 | B2 * | 10/2008 | Murakami et al. | 123/41.65 |
| 7,482,706 | B2 * | 1/2009 | Uchimi et al. | 290/1 A |
| 7,779,793 | B2 * | 8/2010 | Ito et al. | 123/41.65 |
| 8,232,660 | B2 * | 7/2012 | Ito | F02B 63/04 290/1 A |
| 2003/0070652 | A1 | 4/2003 | Suzuki et al. | |
| 2009/0121492 | A1 | 5/2009 | Ito et al. | |
| 2010/0037837 | A1 * | 2/2010 | Yamasaki | F01P 1/06 123/41.6 |

FOREIGN PATENT DOCUMENTS

| | | | |
|---|---|---|---|
| FR | 2 342 574 | | 9/1977 |
| JP | 2003-090224 | A | 3/2003 |
| JP | 2003-097285 | A | 4/2003 |
| JP | 2003-120312 | A | 4/2003 |
| JP | 2003-214176 | A | 7/2003 |
| JP | 2008-82204 | A | 4/2008 |
| JP | 2010-22998 | A | 10/2010 |
| JP | 2010-222998 | A | 10/2010 |

OTHER PUBLICATIONS

Extended European Search Report (EESR) for EP 11856817.9, mailed Jan. 23, 2015 (6 pages).

International Search Report for International Application No. PCT/CN2011/000143, mailed Nov. 3, 2011.

* cited by examiner (a)

(b)

(a)

(b)

(a)

(b)

ENGINE GENERATOR ASSEMBLY

TECHNICAL FIELD

The present invention relates to an engine generator.

BACKGROUND ART

Conventionally, in consideration of use of an engine generator in a city area or at night, measures against noise are taken on the engine generator. For example, in an engine generator of the Patent Literature 1, as a measure against noise, an engine and a generator are covered by a cover. Accordingly, sound generated in the cover (for example, engine sound, intake sound of an air cleaner and the like) is interrupted with the cover, whereby noise can be reduced.

However, in the engine generator of the Patent Literature 1, though the sound generated in the cover is interrupted with the cover, the cover tends to be filled with heat so as to raise temperature therein. Then, in the engine generator of the Patent Literature 1, as measures against high temperature, a cooling fan is provided with each of the engine and the generator, and a plurality of external openings through which outside air is sucked into the cover are provided in the cover. Accordingly, the outside air is sucked into the cover through the external openings by the suction power of the cooling fans, whereby the engine, the generator and the like can be cooled. The cooling fan at the side of the generator is covered by a bracket having an exhaust port, and the bracket is covered by a generator exhaust duct. Accordingly, air discharged from the bracket runs inside the generator exhaust duct, whereby the generator can be cooled.

However, in the engine generator of the Patent Literature 1, while the outside air is sucked into the cover through the external openings, sound generated in the cover leaks through the external openings, whereby noise tends to become large. Then, in the engine generator of the Patent Literature 1, an intake duct is provided for introducing the air, sucked through the external openings, into the cover. Accordingly, attenuation length is enlarged by the intake duct and the sound generated in the cover is attenuated, whereby the noise can be reduced.

Now, the cover is constructed by a cover body which is opened at both sides and a pair of side lids covering both of the side openings. Each of the cover body and the side lids is constructed by a platy member, and the cover body and the side lids are attached to each other by so-called flat plate attachment in which the plate surfaces thereof are overlapped and fixed.

One of the side lids is fixed thereto with an intake box which introduces the air, sucked through the external openings, into the cooling fan at the side of the engine. In the vicinity of the intake box, an intake chamber is formed, and an air cleaner performs intake via the intake chamber so as to reduce intake sound which causes noise. The other of the side lids is fixed thereto with a muffler box in which a muffler of the engine is housed.

Above the generator, an exhaust duct is provided discharging the air in the cover to the outside. The exhaust duct is attached to a stopper formed over the generator. The stopper is fixed to a damper stay, and the engine and the generator are also fixed to the damper stay.

PRIOR ART REFERENCE

Patent Literature

Patent Literature 1: the Japanese Patent Laid Open Gazette 2010-222998

DISCLOSURE OF INVENTION

Problems to be Solved by the Invention

However, in the engine generator of the Patent Literature 1, when the intake duct is miniaturized for making the engine generator compact, the length of the air passage formed in the intake duct, that is, the attenuation length is shortened. Then, there is a problem in that the sound generated in the cover is not attenuated enough and the noise is increased.

There is a problem in that the cover body is vibrated and the noise is increased, because the cover body is constructed by platy members and does not have enough rigidity. Since the space is limited in the vicinity of the intake box inside the casing, there is a problem in that it is difficult to enlarge the capacity of the intake chamber and to reduce the intake sound which causes the noise so as to reduce the noise of the engine generator.

Since the stopper to which the exhaust duct is attached is fixed to the damper stay, the attachment span of the stopper is long. Accordingly, there is a problem in that the exhaust duct, the generator and the engine are not integrated enough and these members do not have enough rigidity so that the exhaust duct is vibrated and the noise is increased.

The generator exhaust duct only covers the bracket simply and the shape thereof does not consider the position of the exhaust port of the bracket and the like. Accordingly, there is a problem in that the air in the vicinity of the exhaust port cannot flow smoothly easily so that the whole air in the generator exhaust duct cannot flow smoothly, that is, the exhaust efficiency of the generator exhaust duct is worsened, thereby tending to raise the temperature of the generator, in its turn the whole engine generator. When the temperature of the engine generator is raised, the output of the generator may be reduced.

The present invention is provided in consideration of the conditions as mentioned above and the purpose of the invention is to provide an engine generator which can reduce noise and performs cooling efficiently.

Means for Solving the Problems

The problems to be solved by the present invention have been described above, and subsequently, the means of solving the problems will be described below.

An engine generator according to the present invention having an engine, a generator driven by the engine, a cover covering the engine and the generator, and a muffler box in which a muffler of the engine is housed, includes a first external opening formed in the cover for sucking outside air into the cover, and an intake duct for introducing the air sucked via the first external opening into the inside of the cover. An opening is formed in the upper side of the intake duct, and the intake duct is arranged along the side surface of the muffler box and below the upper surface of the muffler box for a predetermined distance. A sound absorbing member is provided between the upper side of the intake duct and the side surface of the muffler box so as to cover a part of the opening. An air passage is formed above the intake duet by the side surface of the muffler box and the sound absorbing member.

In the engine generator according to the present invention, the cover has a cover body in which both sides thereof are opened and a pair of side lids covering the openings of both sides of the cover body, a rib is formed in each of the openings of both sides of the cover body, and the muffler box is fixed to one of the ribs.

The engine generator according to the present invention further includes an engine cooling fan provided to the engine, a second external opening formed in the cover for sucking outside air into the cover, and an intake box for introducing the air sucked via the second external opening into the engine cooling fan. An air cleaner of the engine is communicated through an intake hose to the intake box.

In the engine generator according to the present invention, the intake box is fixed to the other one of the ribs.

In the engine generator according to the present invention, the inside of the intake box is partitioned by a partition plate, and the partition plate is arranged between the connection part of the intake box and the intake hose and the second external opening.

In the engine generator according to the present invention, an exhaust duct for discharging air in the cover to the outside is provided above the generator, and an attachment base to which the exhaust duct is attached is provided on the upper surface of the generator.

In the engine generator according to the present invention, a generator cooling fan is provided to the generator, the generator cooling fan is covered by a bracket having an exhaust port, the bracket is covered by a generator exhaust duct, and the generator exhaust duct is provided therein with an expansion part which expands outward along the rotational radial direction of the generator cooling fan and faces the exhaust port.

Effect of the Invention

The present invention brings the following effects.

According to the engine generator of the present invention, the attenuation length is extended by the air passage so that the sound generated in the cover is attenuated enough, thereby reducing the noise.

According to the engine generator of the present invention, the rib improves the rigidity of the cover body, and the cover body and the muffler box are constructed integrally so as to improve the rigidity thereof, thereby reducing the vibration of the cover body so as to reduce the noise.

According to the engine generator of the present invention, the intake box serves as an intake chamber, whereby it is not necessary to provide any intake chamber of exclusive use. Accordingly, by employing surplus space around the intake box so as to increase the capacity of the intake box, the intake sound which causes the noise can be reduced. By omitting the intake chamber of exclusive use, the weight of the whole engine generator can be reduced and the number of parts thereof can be reduced, whereby the cost can be reduced.

Furthermore, according to the engine generator of the present invention, the cover body and the intake box are constructed integrally so as to improve the rigidity thereof, thereby reducing the vibration of the cover body so as to reduce the noise.

According to the engine generator of the present invention, the attenuation length is extended by the partition plate so that the intake sound is attenuated enough, thereby reducing the noise.

According to the engine generator of the present invention, the exhaust duct is attached to the attachment base. Accordingly, the exhaust duct, the generator and the engine are constructed integrally so as to improve the rigidity thereof, thereby reducing the vibration of the exhaust duct so as to reduce the noise.

Furthermore, according to the engine generator of the present invention, the expansion part makes the flowing of air in the vicinity of the exhaust port smooth, thereby making the whole inside of the exhaust duct of the generator smooth so as to cool efficiently the generator, in its turn the whole engine generator.

BRIEF DESCRIPTION OF DRAWINGS

FIG. 2(*b*) is a left side view of the engine generator.

FIG. 3(*b*) is a right side view of the engine generator.

FIG. 5(*b*) is a right side view of the inner structure of the engine generator.

FIG. 6(*b*) is a perspective view of the intake duct.

FIG. 7(*b*) is an arrow sectional view of the line A-A in FIG. 7(*a*).

FIG. 8(*b*) is a perspective view of the muffler box.

FIG. 9(*b*) is a perspective view of a rib.

FIG. 10(*b*) is a perspective view of the inner structure of the muffler box.

FIG. 12(*b*) is an arrow sectional view of the line B-B in FIG. 12(*a*).

FIG. 15(*b*) is a perspective view of an attachment base.

FIG. 18(*b*) is a sectional side view of the generator exhaust duct.

FIG. 19(*b*) is a perspective rear view of the generator front bracket.

DESCRIPTION OF NOTATIONS

Figure 1:
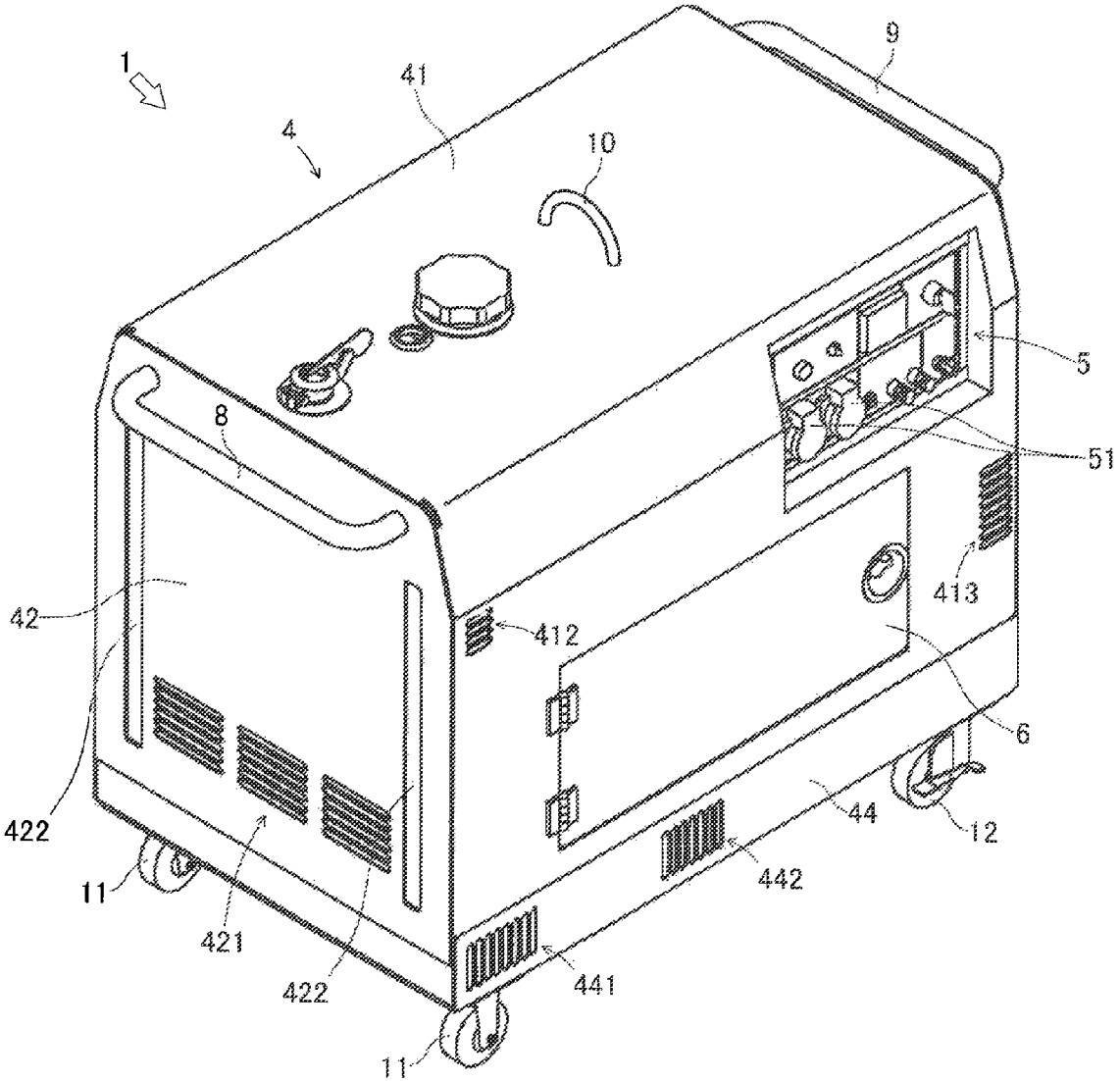
FIG. 1 is a perspective view of an engine generator.

1 engine generator
2 engine
3 generator
4 cover
7 intake duct
13 muffler box
15 exhaust duct
17 sponge (sound absorbing member)
18 air passage
23 air cleaner
25 engine cooling fan
27 intake hose
28 intake box
32 generator rear bracket (bracket)
33 generator cooling fan
34 generator exhaust duct
41 cover body
43 left side lid
43 right side lid
71 opening
241 muffler
242 muffler
286D outer partition plate
321 attachment base
342 first expansion cover (expansion part)
343 second expansion cover (expansion part)
351 first exhaust port (exhaust port)
352 second exhaust port (exhaust port)
412 external opening (first external opening)
413 external opening (second external opening)
414 external opening (first external opening)
415 external opening (second external opening)
416 rib
C connection part

DETAILED DESCRIPTION OF THE INVENTION

An explanation will be given on an embodiment for carrying out the present invention referring to drawings.

Firstly, an explanation will be given on entire construction of an engine generator 1 according to an embodiment of the present invention referring to FIGS. 1 to 5. A position and direction of each of members described below is explained while a direction shown by an arrow F in FIG. 1 is regarded as "forward direction", an arrow U is regarded as "upward direction", and an arrow L is regarded as "leftward direction".

The engine generator 1 has an engine 2, a generator 3 driven by the engine 2, and a cover 4 covering the engine 2 and the generator 3.

Figure 2:
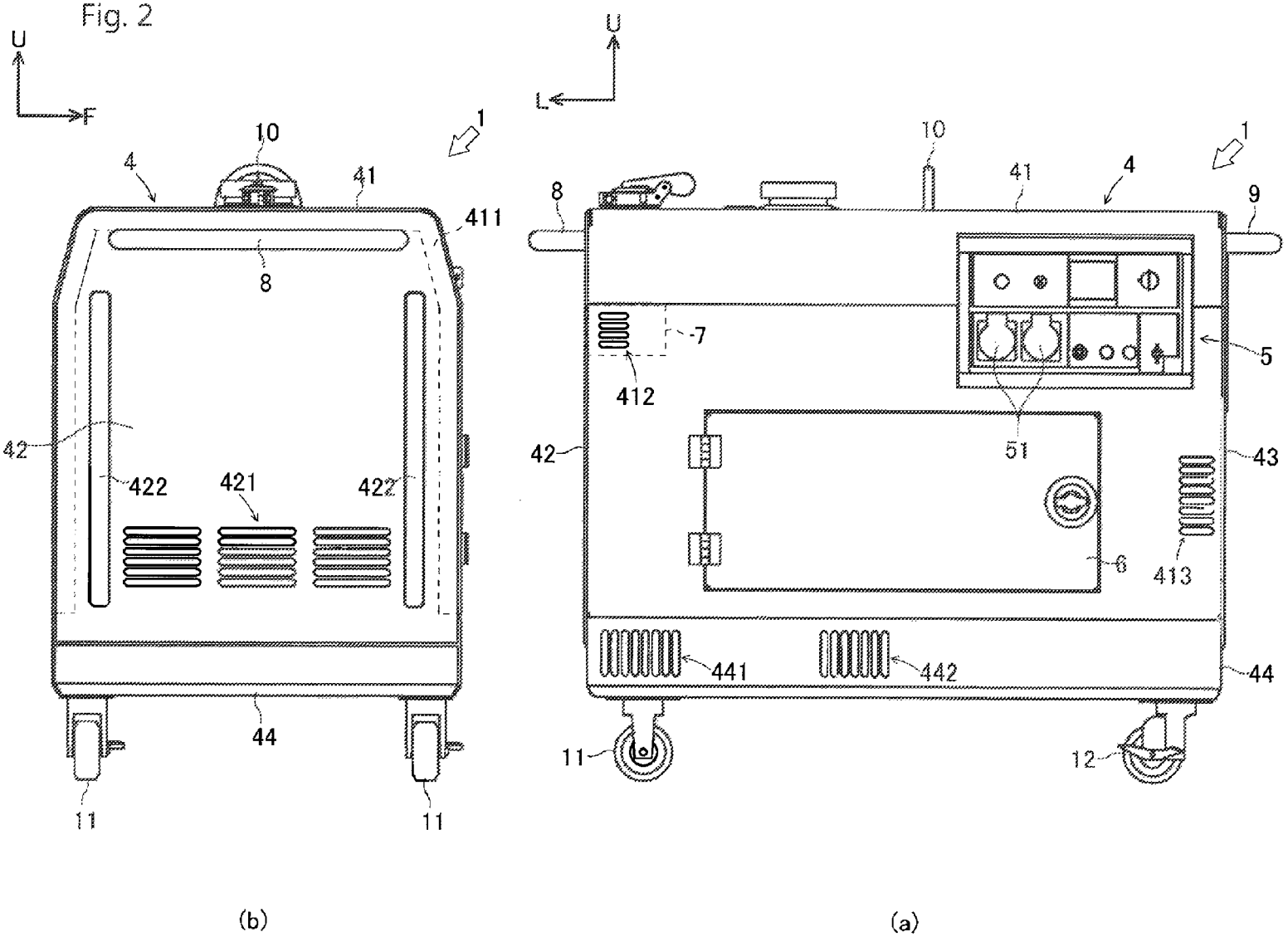
FIG. 2(*a*) is a front view of the engine generator.
Figure 3:
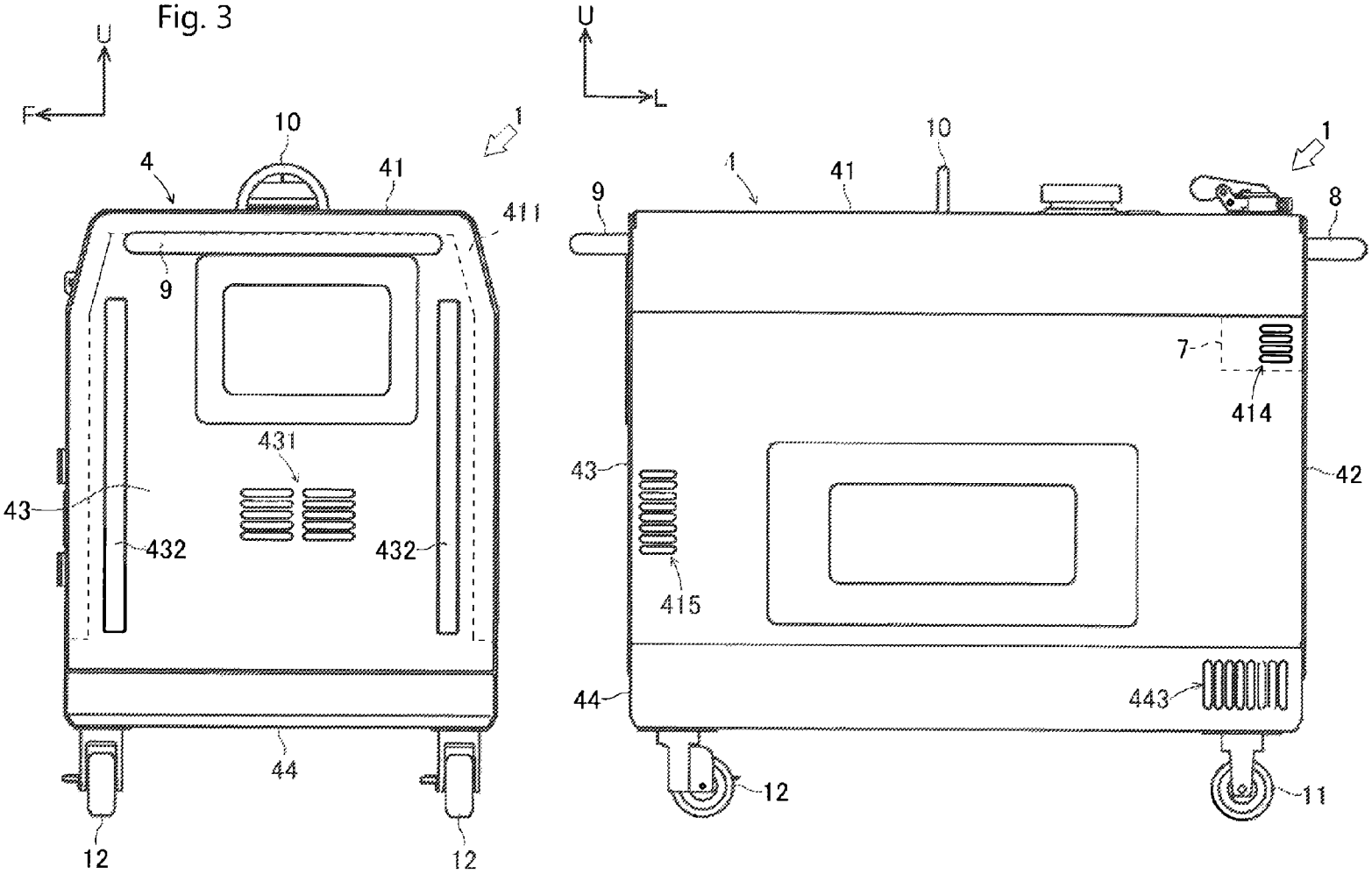
FIG. 3(*a*) is a rear view of the engine generator.

As shown in FIGS. 1 to 3, the cover 4 has a cover body 41 which is substantially reverse U-like shaped when viewed in side and is opened at left, right and bottom sides, a pair of side lids 42 and 43 covering left and right side openings of the cover body 41, and a lower casing 44 covering a lower opening of the cover body 41. At the left and right sides of the cover body 41, two attachment surfaces 411 are provided to which the side lids 42 and 43 are attached.

In the upper right portion of the front surface of the cover body 41, an operation panel 5 is provided for controlling the engine generator 1. In the operation panel 5, two plug sockets 51 having waterproof covers and the like are provided. At the substantially longitudinal center of the cover body 41, a door 6 is provided. The door 6 can be rotated laterally with its left side as a rotation fulcrum so as to be opened and closed. In the upper surface of the cover body 41, a hook 10 is provided for pulling up the engine generator 1.

At the front side of the cover body 41, external openings 412 and 413 are formed for sucking outside air into the cover 4. The external opening 412 is arranged at the upper left portion of the front side of the cover body 41, and the external opening 413 is arranged at the lower right portion of the front side of the cover body 41. Similarly to the front side of the cover body 41, at the rear side of the cover body 41, external openings 414 and 415 are formed for sucking outside air into the cover 4. The external opening 414 is arranged at the upper left portion of the rear side of the cover body 41, and the external opening 415 is arranged at the lower right portion of the rear side of the cover body 41. The external opening 412 at the front side of the cover body 41 and the external opening 414 at the rear side of the cover body 41 are arranged symmetrically longitudinally, and the external opening 413 at the front side of the cover body 41 and the external opening 415 at the rear side of the cover body 41 are arranged symmetrically longitudinally. Inside the external openings 412 and 414 at the front and rear sides of the cover body 41, two intake ducts 7 are provided respectively. The intake ducts 7 will be explained later.

In the upper portion of the left side lid 42, a left handle 8 is provided which is a handle at the time of moving the generator 1. In the lower portion of the left side lid 42, an external opening 421 is formed for discharging air in the cover 4 to the outside. The external opening 421 is arranged at the substantially longitudinal center of the left side lid 42. At the front and rear sides of the left side lid 42 about the external opening 421, two pressed ribs 422 which are respectively extended vertically are formed. Accordingly, the rigidity of the left side lid 42 is improved. The pressed ribs 422 are formed so as to be recessed toward the inside of the cover 4.

In the upper portion of the right side lid 43, a right handle 9 is provided which is a handle at the time of moving the engine generator 1. In the lower portion of the right side lid 43, an external opening 431 is formed for sucking outside air into the cover 4. The external opening 431 is arranged at the substantially longitudinal center of the right side lid 43. At the front and rear sides of the right side lid 43 about the external opening 431, two pressed ribs 432 which are respectively extended vertically are formed. Accordingly, the rigidity of the right side lid 43 is improved. The pressed ribs 432 are formed so as to be recessed toward the inside of the cover 4.

At the front side of the lower casing 44, external openings 441 and 442 are formed for sucking outside air into the cover 4. The external opening 441 is arranged at the left portion of the front side of the lower casing 44, and the external opening 442 is arranged at a position near the lateral center of the front side of the lower casing 44. At the rear side of the lower casing 44, an external opening 443 is formed through which outside air is sucked into the cover 4. The external opening 443 is arranged at the left side of the rear portion of the lower casing 44. The external opening 441 at the front side of the lower casing 44 and the external opening 443 at the rear side of the lower casing 44 are arranged symmetrically longitudinally. Two fixed casters 11 and two free casters 12 are attached to the four corners of the lower surface of the lower casing 44. The fixed casters 11 are arranged at the left side of the lower surface of the lower casing 44, and the free casters 12 are arranged at the right side of the lower surface of the lower casing 44. Accordingly, the engine generator 1 can be moved easily and the moving direction of the engine generator 1 can be changed easily.

Figure 4:
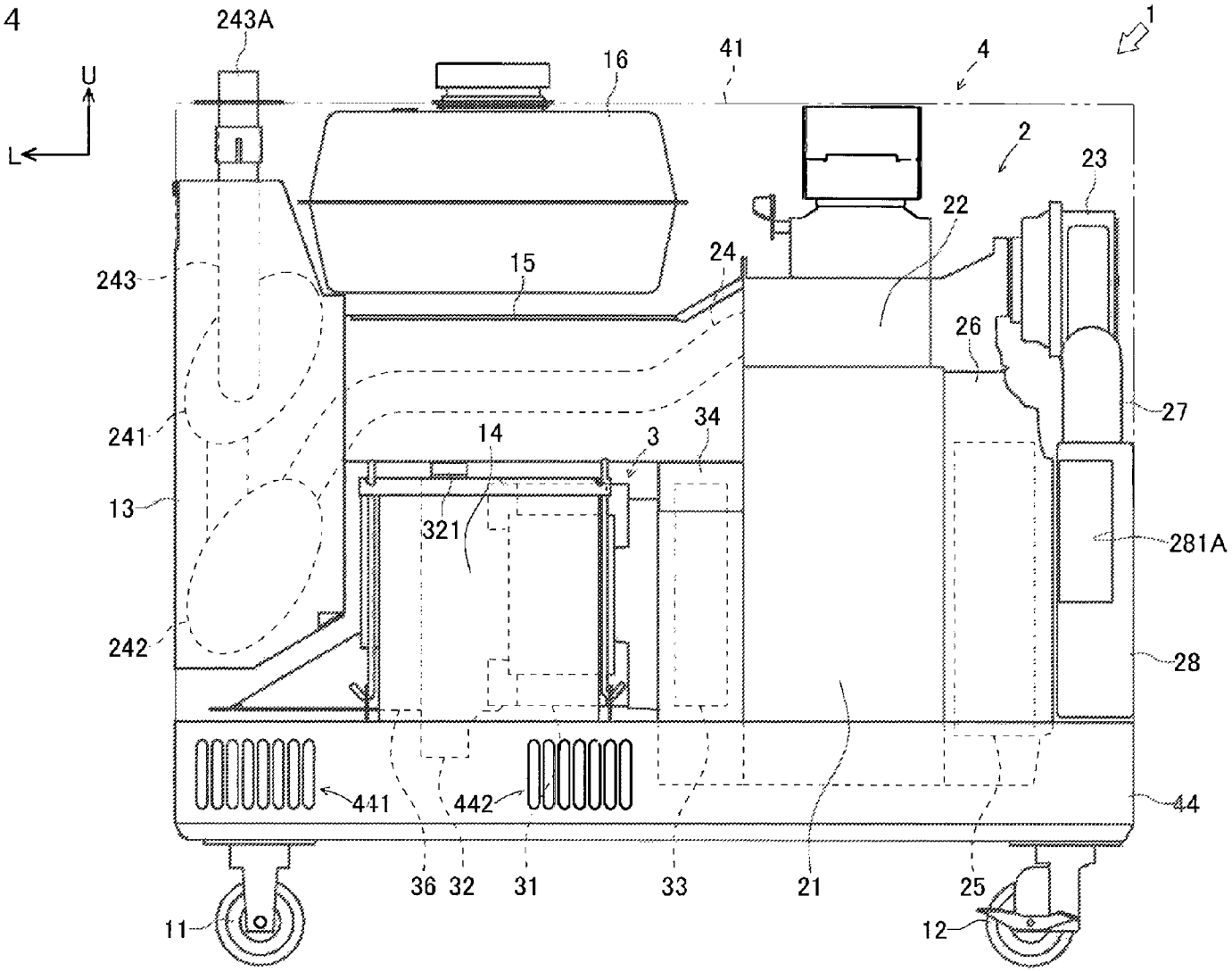
FIG. 4 is a front view of an inner structure of the engine generator.
Figure 5:
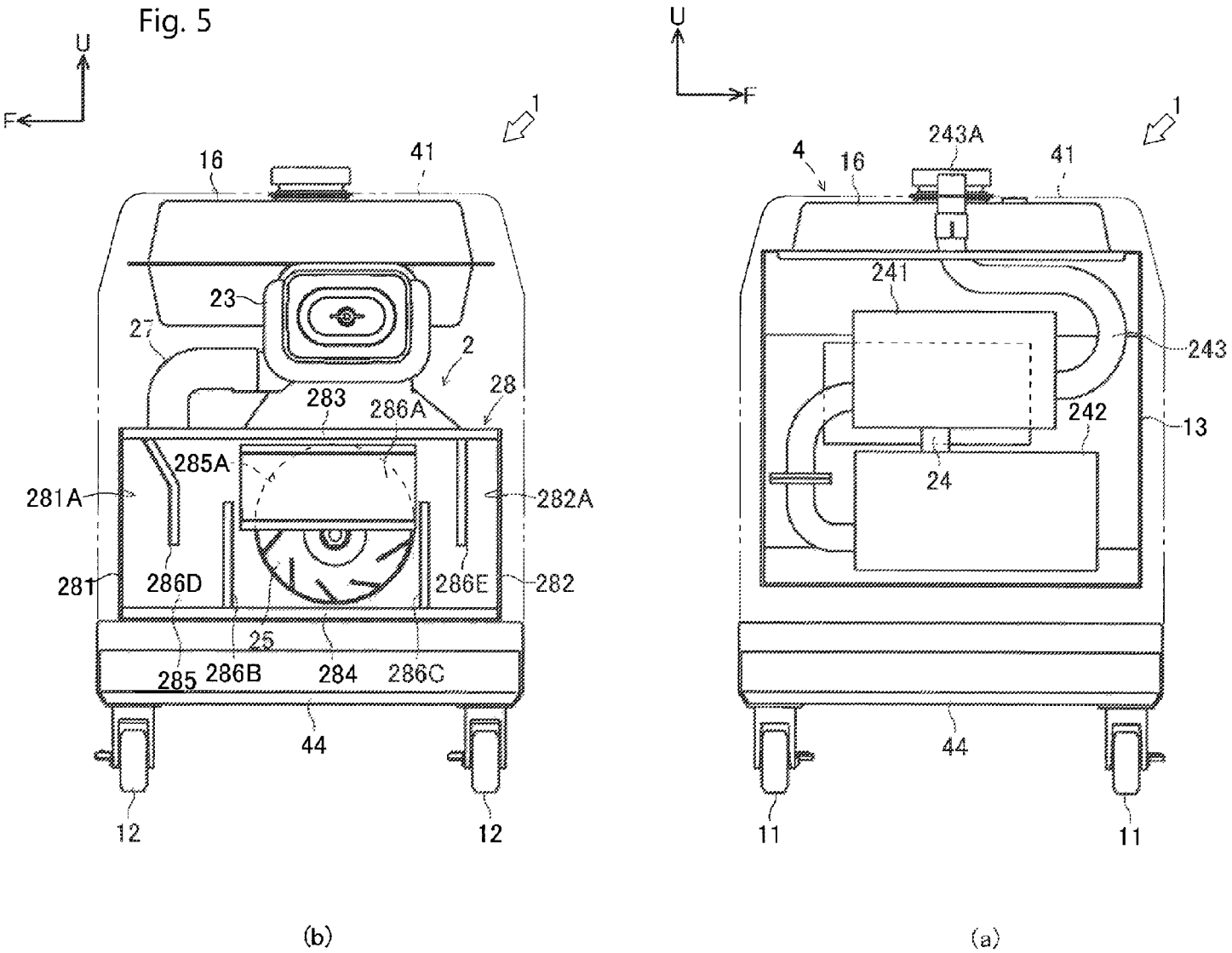
FIG. 5(*a*) is a left side view of the inner structure of the engine generator.

As shown in FIGS. 4 and 5 in the engine 2, a cylinder head 22 is attached above a cylinder block 21. At the right side of the cylinder block 21, a fan casing 26 is attached in which an engine cooling fan 25 is stored. The engine cooling fan 25 is rotated by power of a crankshaft (not shown). An intake port and an exhaust port (not shown) are formed in the cylinder head 22. An air cleaner 23 is attached to the intake port, and an exhaust pipe 24 is attached to the exhaust port.

The air cleaner 23 is connected to an intake box 28 via an intake hose 27. At the front and rear sides of the intake box 28, openings 281A and 282A are respectively formed. Each of the openings 281A and 282A at the front and rear sides are substantially rectangular and vertically long when viewed in front.

The exhaust pipe 24 is provided laterally, and mufflers 241 and 242 are provided at the middle of the exhaust pipe 24. The mufflers 241 and 242 are housed in a muffler box 13 and aligned above and below. From the upper muffler 241, a tail pipe 243 of the exhaust pipe 24 is extended upward, and an exhaust port 243A of the tail pipe 243 is projected upward from the upper surface of the cover body 41. The exhaust port 243A is arranged at the substantially center of the engine generator 1 in the longitudinal direction. Accordingly, the exhaust port 243A is kept away from the side of the operation panel 5 (the front side) of the engine generator 1, whereby exhaust gas discharged from the exhaust port 243A is hardly blown to an operator at the side of the operation panel 5 (the front side) of the engine generator 1.

The generator 3 is arranged at the left of the engine 2. The generator 3 has a generator body 31 constructed by a rotor (not shown) and the like, and at the left and right sides of the generator body 31, a generator rear bracket 32 and a generator cooling fan 33 are respectively provided. The generator cooling fan 33 is covered by a generator exhaust duct 34. The rotor of the generator body 31 and the generator cooling fan 33 are rotated by power of the crankshaft of the engine 2. At the left side of the rear bracket 32, a generator intake duct 36 is provided which introduces air to the side of the generator cooling fan 33. The air introduced by the generator intake duct 36 is sucked through the external openings 441 and 442 at the front side of the lower casing 44, the external opening 443 at the rear side of the lower casing 44 (see FIG. 3(*a*)) and the like.

Before the generator 3, a battery 14 is provided. By opening and closing the door 6 (see FIG. 1), the maintenance of the battery 14 and the like can be performed easily. Above the generator 3, an exhaust duct 15 is provided, and above the exhaust duct 15, a fuel tank 16 is provided in which fuel for the engine 2 is stored.

The exhaust duet 15 is provided laterally, and the left and right sides thereof are opened. The left and right ends of the exhaust duct 15 are fixed respectively to the right side surface of the muffler box 13 and the left side surface of the engine 2 (the cylinder block 21 or the like) by bolts (not shown) or the like. The exhaust duct 15 is attached to an attachment base 321 attached to the upper surface of the generator rear bracket 32. Details of the attachment base 321 will be discussed later.

Figure 6:
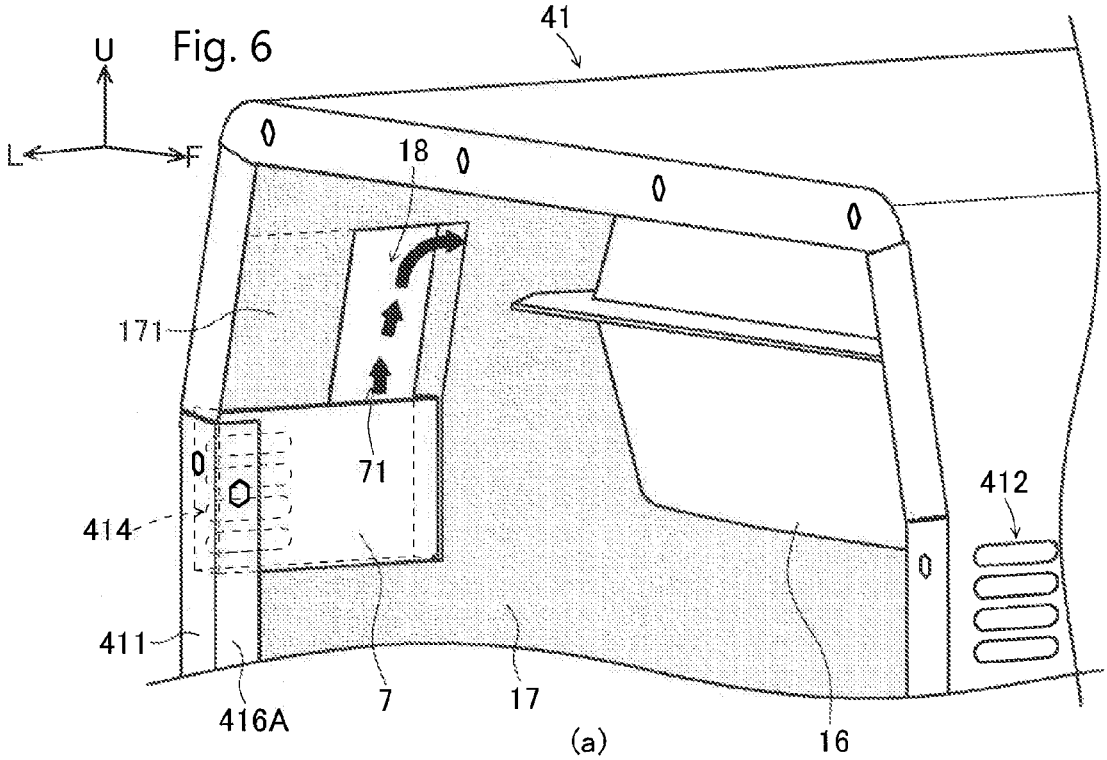
FIG. 6(*a*) is a perspective view of an intake duct and circumference thereof.
Figure 6:
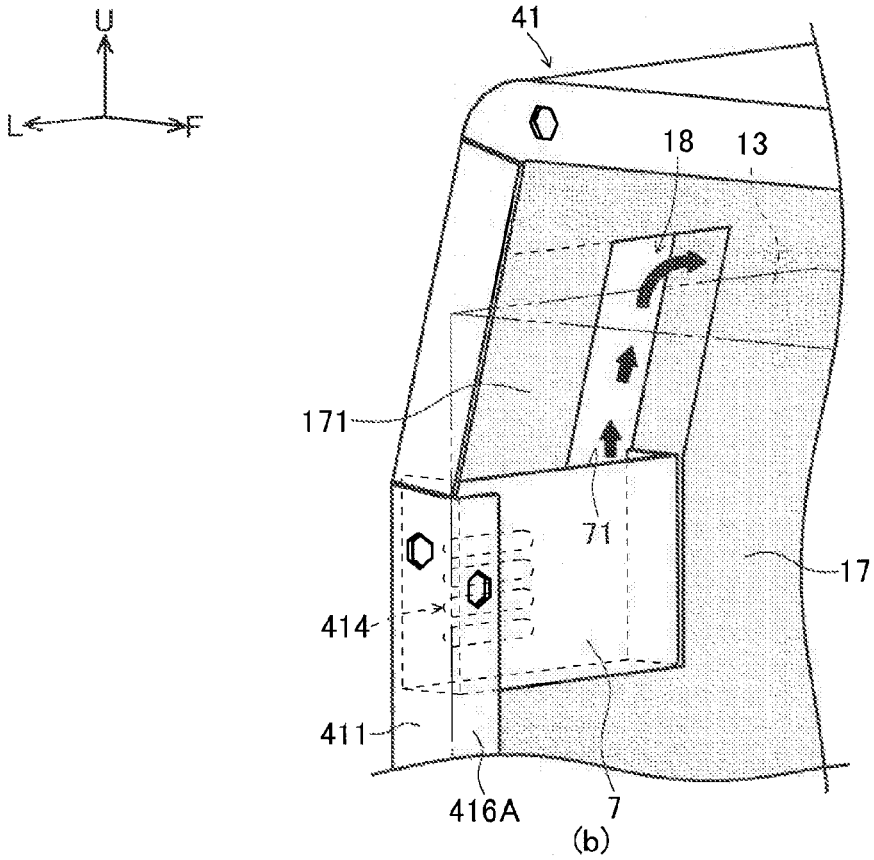
Figure 7:
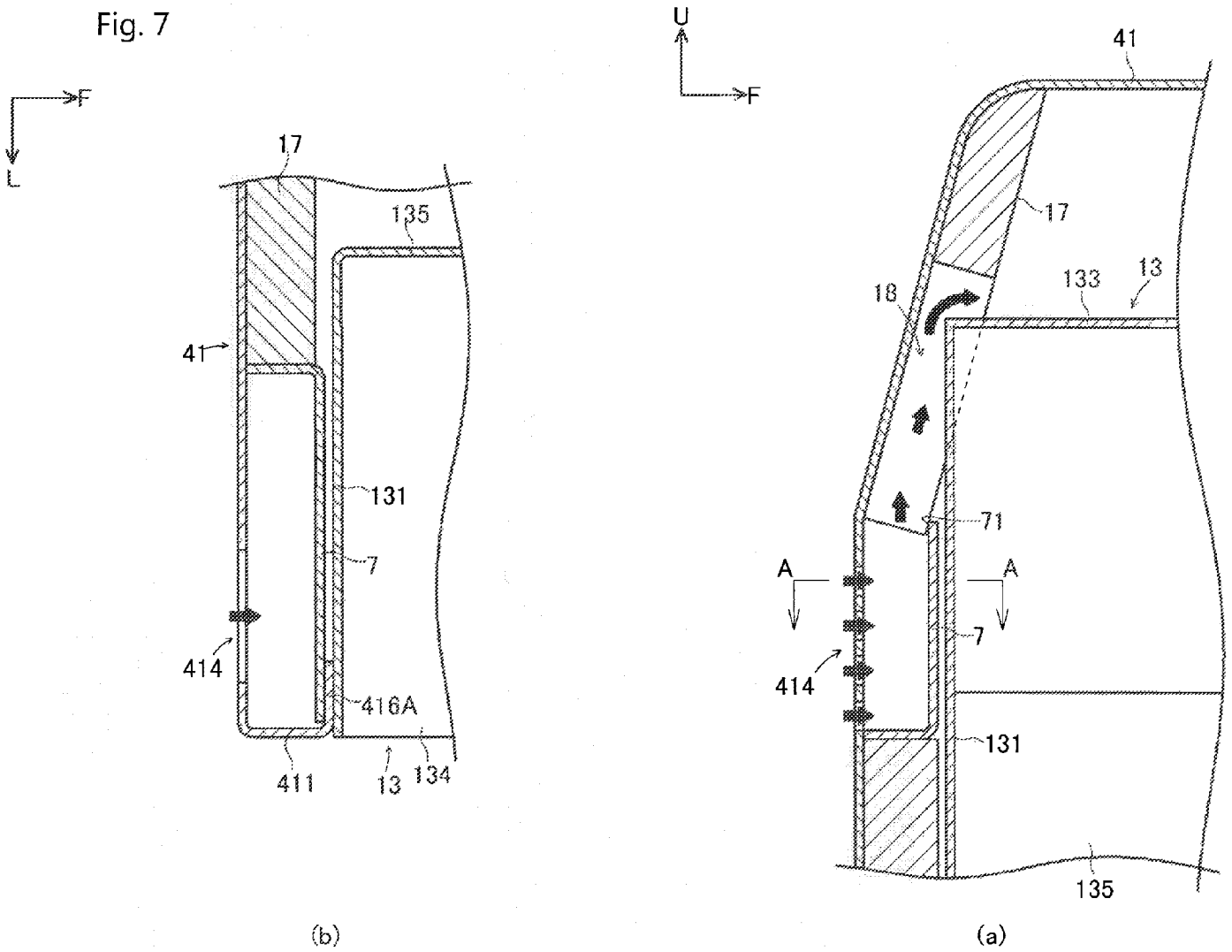
FIG. 7(*a*) is a sectional side view of the intake duct and a muffler box.

Next, an explanation will be given on the intake ducts 7 referring to FIGS. 6 and 7. Herein, as an example, the intake duct 7 at the rear side of the cover body 41 is explained. Thick black arrows in FIGS. 6 and 7 show air flows.

The intake duct 7 has a bottom and an opening 71 is provided in the upper side thereof. The intake duct 7 is arranged below the upper surface of the muffler box 13 for a predetermined distance along the rear surface of the muffler box 13. Around the intake duct 7, in the inner surface of the cover body 41, a sponge member 17 as a sound insulator is stuck. A part of the sponge member 17 (sponge piece 171 shown in FIG. 6) is provided between the upper portion of the intake duct 7 and the rear surface of the muffler box 13 so as to cover only the left half of the opening 71, that is, so as not to cover the right half of the opening 71. Above the intake duct 7, an air passage 18 is formed by the rear surface of the muffler box 13 and the sponge member 17.

According to the construction, air sucked through the external opening 414 runs in the intake duct 7 and flows into the air passage 18 through the opening 71. Then, air in the air passage 18 runs upward along the muffler box 13, and flows out from the air passage 18 through the upper end of the air passage 18 and runs near the fuel tank 16. Accordingly, the air sucked through the external opening 414 is introduced into the cover 4 by the intake duct 7. Similarly, air sucked through the external opening 412 is introduced into the cover 4 by the intake duct 7. Subsequently, the air having run near the fuel tank 16 flows into the exhaust duct 15 through the front end opening of the exhaust duct 15, and runs from the exhaust duct 15 in the muffler box 13 and is discharged outside the cover 4 through the external opening 421.

On the other hand, sound generated in the cover 4 leaks from the external openings 412 and 414 via the air passages 18 and the intake ducts 7 of the front and rear sides. For enlarging attenuation length of the sound generated in the covet 4, preferably, the intake ducts 7 are arranged below as much as possible from the upper surface of the muffler box 13.

Next, an explanation will be given on the cover body 41, the muffler box 13 and the intake box 28 referring to FIGS. 8 to 14. Thick black arrows in FIGS. 10(*b*) and 14 show an air flow.

Figure 8:
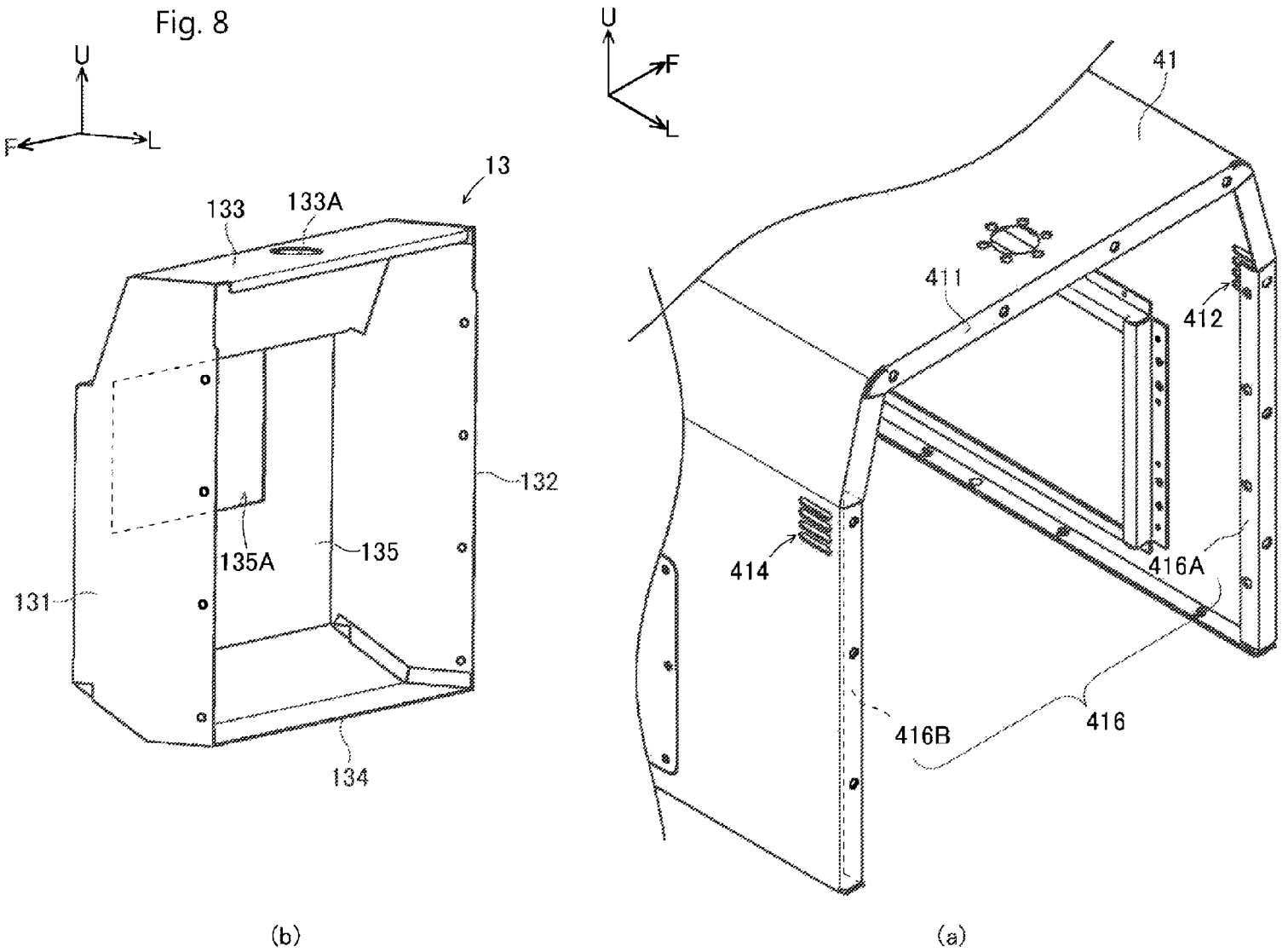
FIG. 8(*a*) is a perspective view of a left side of a cover body.
Figure 9:
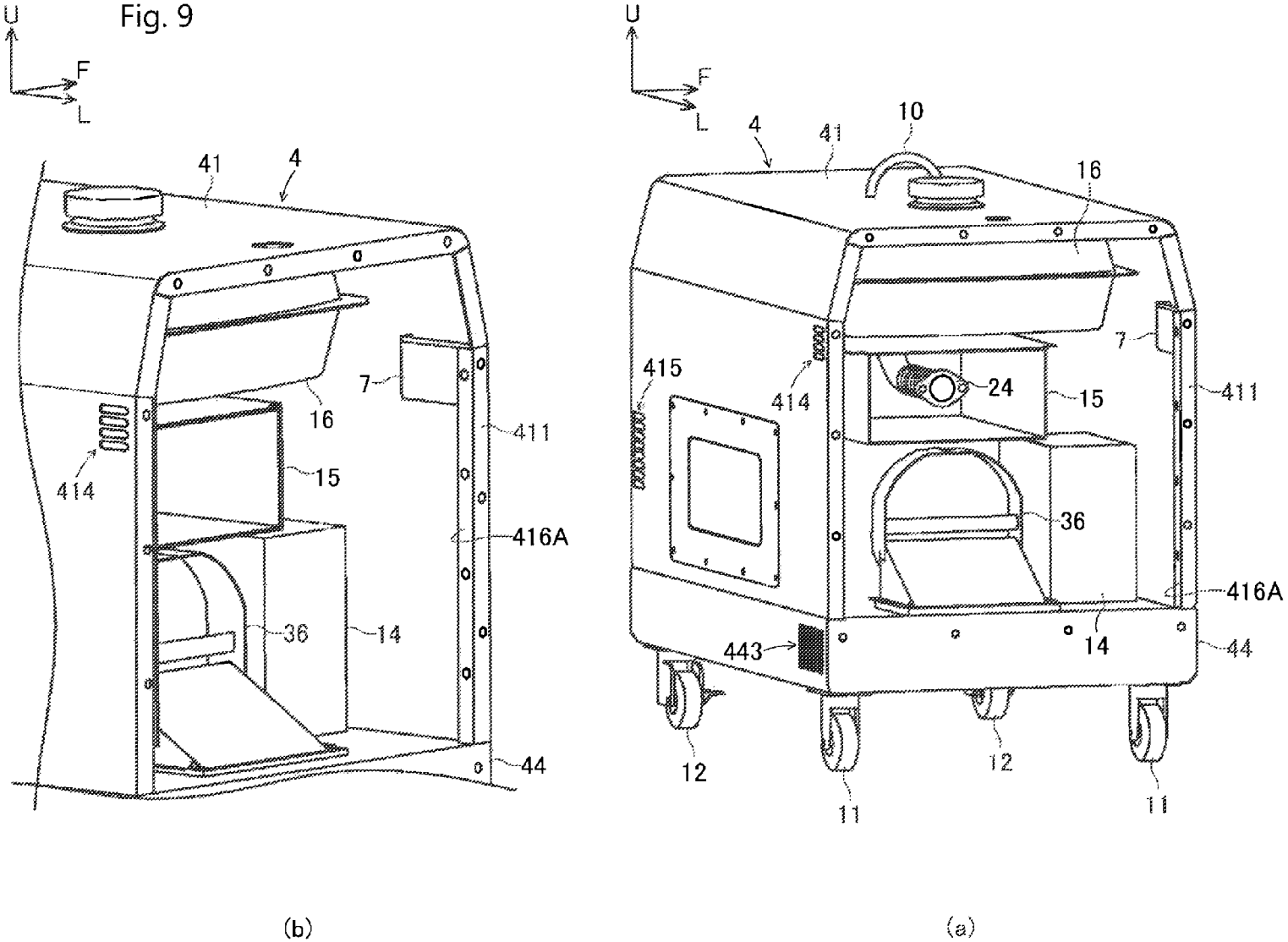
FIG. 9(*a*) is a perspective view showing the state in which the muffler box is detached from the cover body.

As shown in FIGS. 8(*a*) and 9, at the left side of the cover body 41, a rib 416 is formed. Similarly to the left side of the cover body 41, a rib 416 is formed at the right side of the cover body 41. Herein, as an example, only the rib 416 at the left side of the cover body 41 is explained. The rib 416 is constructed by a front rib 416A formed at the front side of the cover body 41 and a rear rib 416B formed at the rear side of the cover body 41. The front and rear ribs 416A and 416B are bent toward the inner side of the cover body 41 substantially perpendicularly to the attachment surface 411 at the side of the free end of the attachment surface 411.

Figure 10:
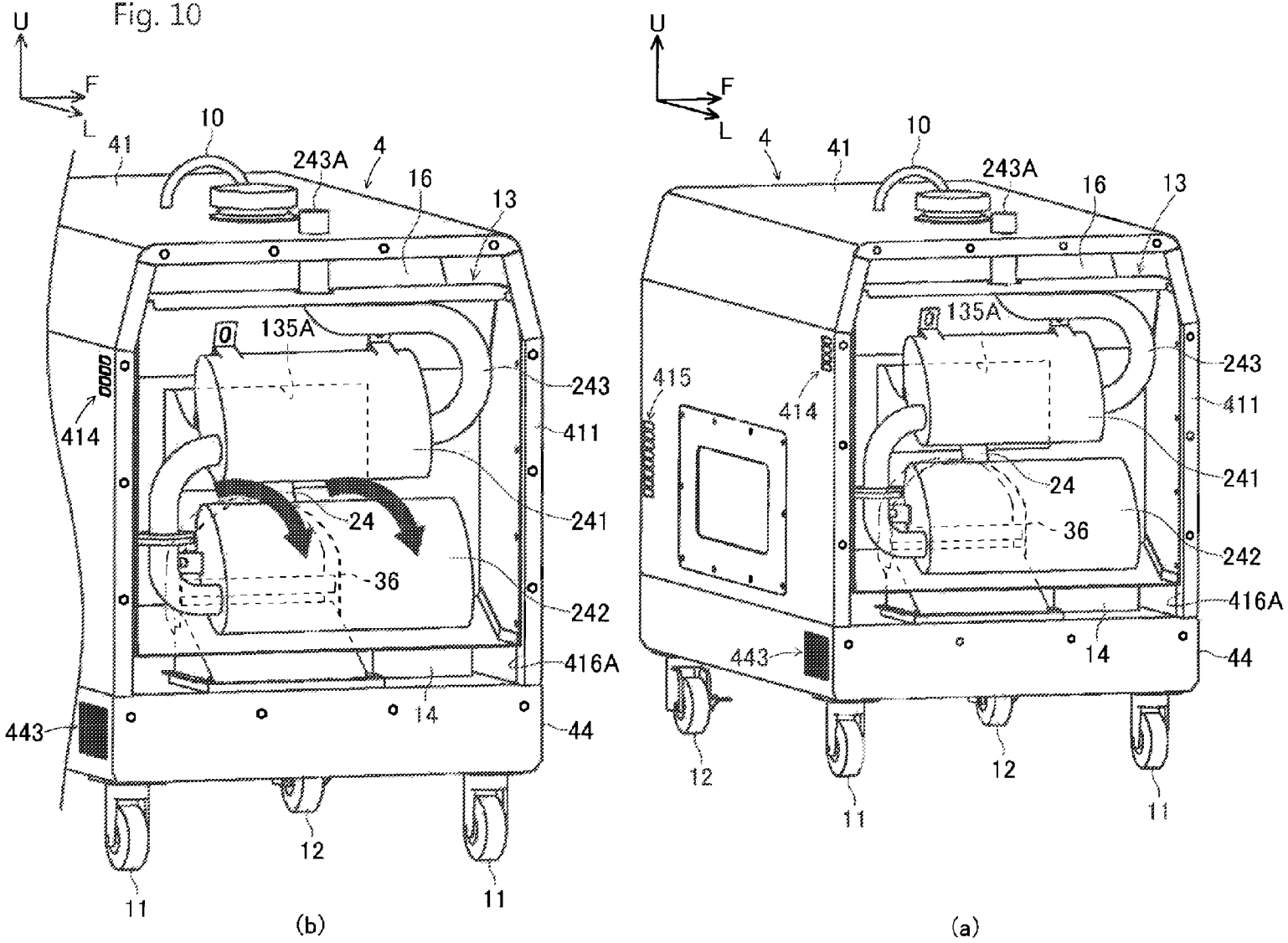
FIG. 10(*a*) is a perspective view showing the state in which the muffler box is attached to the cover body.
Figure 11:
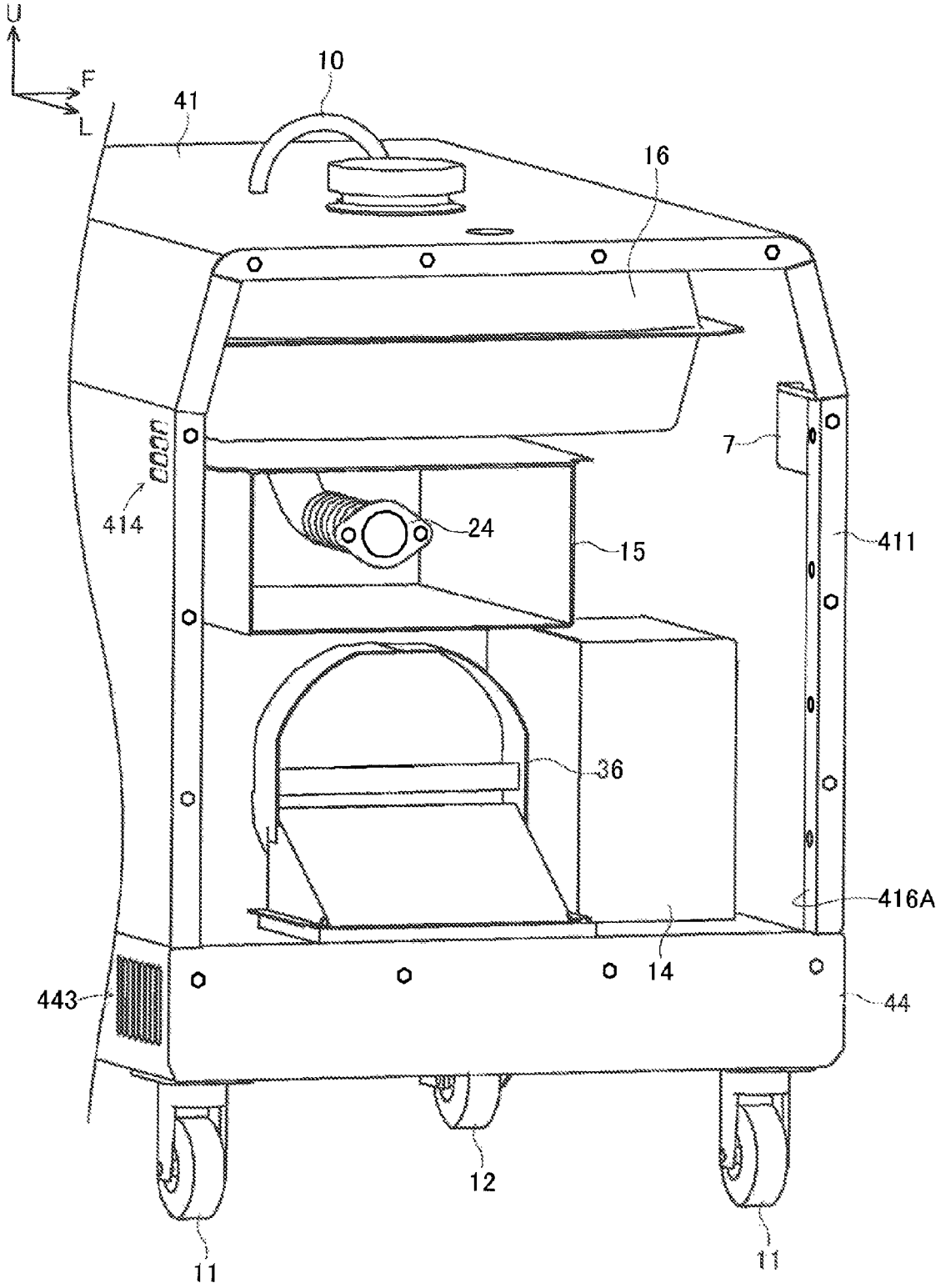
FIG. 11 is a perspective view of a generator intake duct and circumference thereof.
Figure 12:
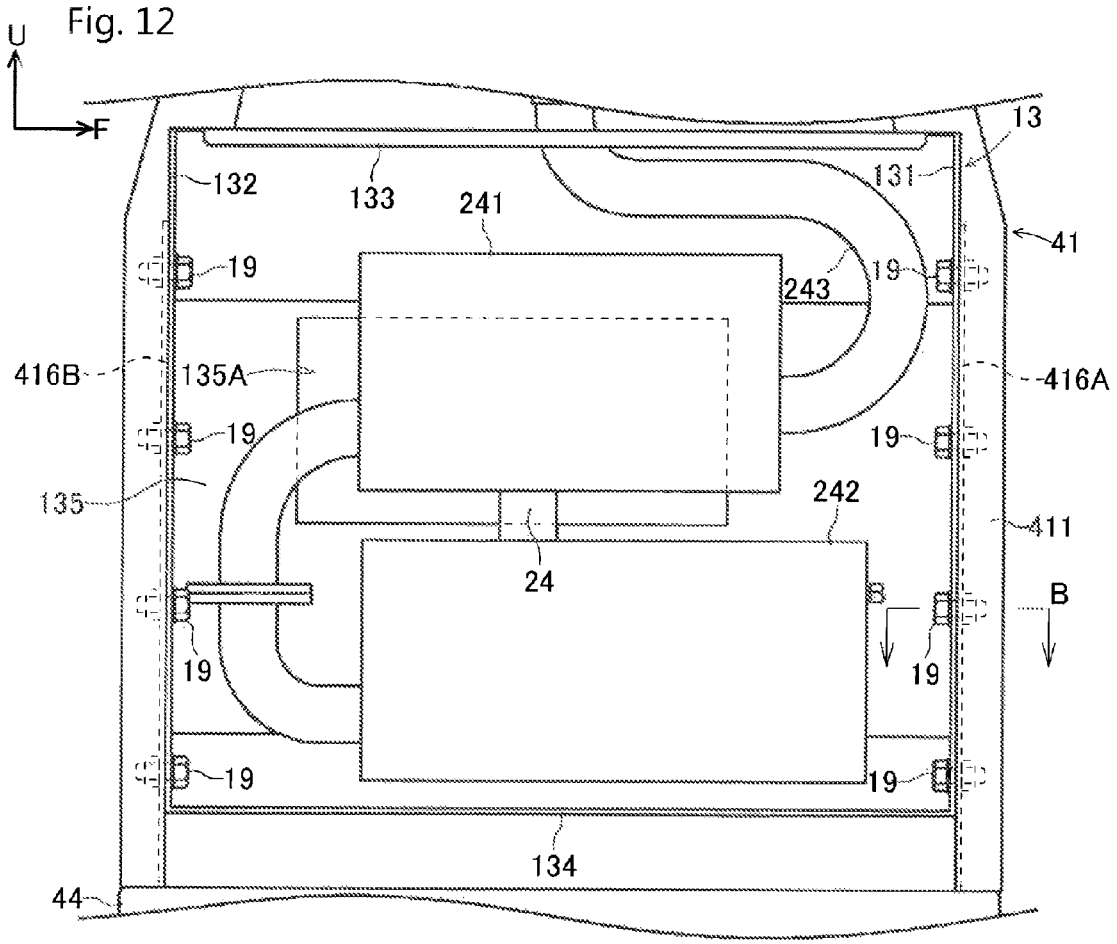
FIG. 12(*a*) is a left side view of the muffler box attached to the cover body.
Figure 12:
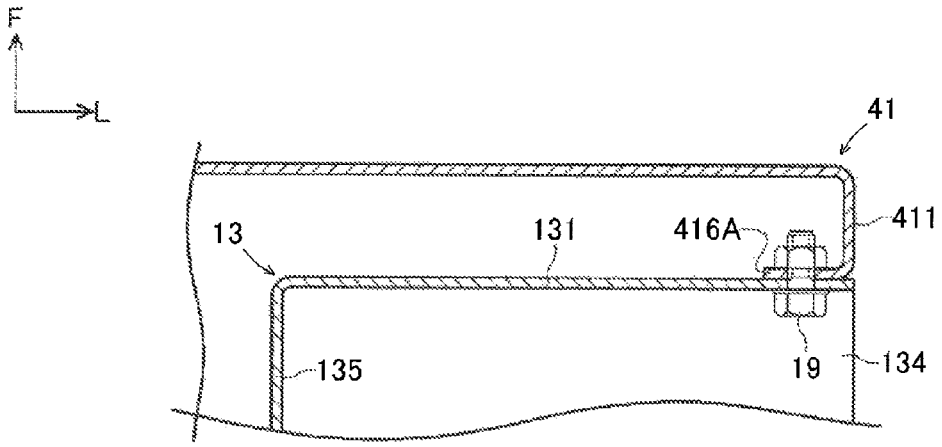

As shown in FIG. 8(*b*), the muffler box 13 is a box-like member constructed by combining a front plate 131, a rear plate 132, a top plate 133, a bottom plate 134 and a right side plate 135 etc., and the left side of the muffler box 13 is opened. The left opening of the muffler box 13 is covered by the left side lid 42. In the top plate 133, an insertion hole 133A is formed into which the tail pipe 243 (the exhaust port 243A) of the exhaust pipe 24 is inserted. In the right side plate 135, an opening 135A is formed which is connected to the left end of the exhaust duct 15. As shown in FIG. 10(*b*), air from the left end opening of the exhaust duct 15 flows through the opening 135A into the muffler box 13. As shown in FIGS. 10 and 11, the rear surface (the right side surface) of the right side plate 135 of the muffler box 13 seals the left end opening of the generator intake duct 36, whereby air in the generator intake duct 36 does not leak. Accordingly, a duct structure is constructed by the generator intake duct 36 and the rear surface (the right side surface) of the right side plate 135. A sponge member (not shown) as a seal member is stuck to the rear surface (the right side surface) of the right side plate 135. As shown in FIG. 12, among the front plate 131 and the rear plate 132, the front plate 131 is fixed to the front rib 416A by a plurality of bolts (in this embodiment four bolts) 19, and the rear plate 132 is fixed to the rear rib 416B by a plurality of bolts (in this embodiment, four bolts) 19.

Figure 13:
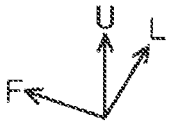
FIG. 13 is a perspective view of an intake box attached to the cover body.
Figure 13:
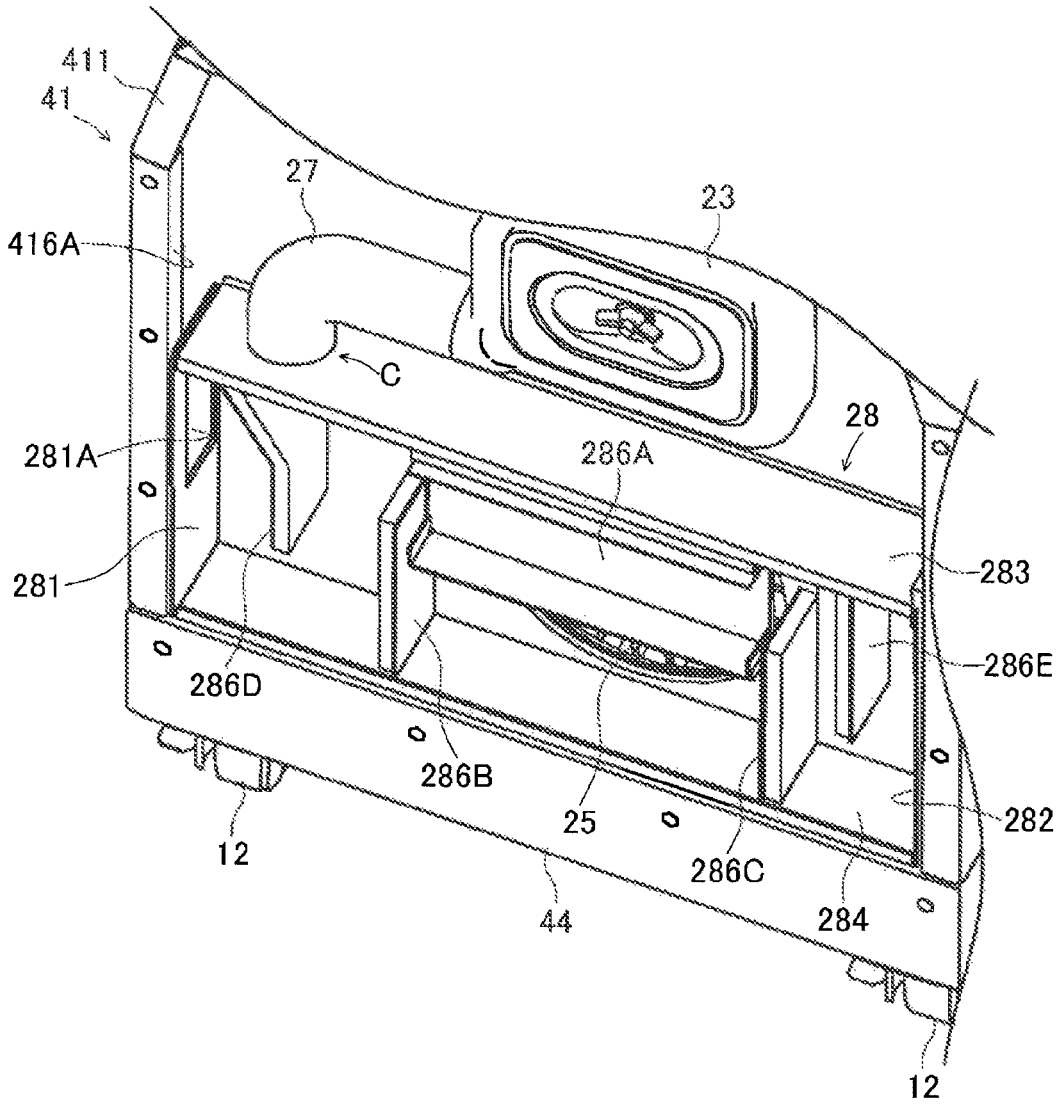
Figure 14:
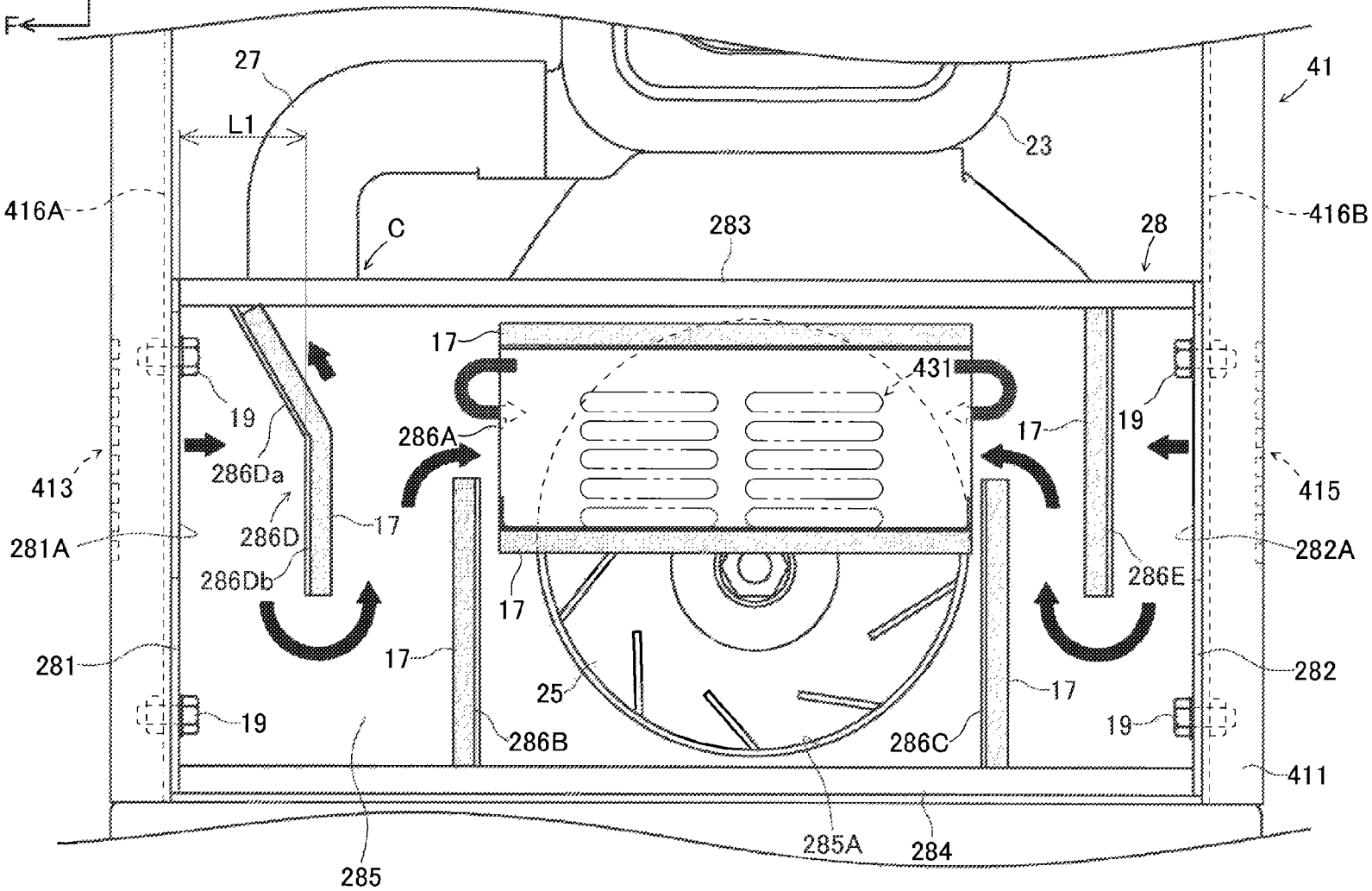
FIG. 14 is a right side view of the intake box attached to the cover body.

As shown in FIGS. 13 and 14, the intake box 28 is a box-like member constructed by combining a front plate 281, a rear plate 282, a top plate 283, a bottom plate 284 and a left side plate 285, and the right side of the intake box 28 is opened. The right opening of the intake box 28 is covered by the right side lid 43. One of the ends of the intake hose 27 is connected to the front side of the top plate 283. The other end of the intake hose 27 is connected to the air cleaner 23. The openings 281A and 282A mentioned above are formed respectively in the front plate 281 and the rear plate 282. The opening 281A of the front side is arranged to face the external opening 413, and the opening 282A of the rear side is arranged to face the external opening 415. Among the front plate 281 and the rear plate 282, the front plate 281 is fixed to the front rib 416A by a plurality of bolts (in this embodiment, two bolts) 19, and the rear plate 282 is fixed to the rear rib 416B by a plurality of bolts (in this embodiment, two bolts) 19.

In the left side plate 285, an opening 285A facing the engine cooling fan 25 is formed. The opening 285A is substantially circular when viewed in side, and the upper half thereof is covered by a cover 286A attached to the right side lid 43. The cover 286A is substantially rectangular and laterally long when viewed in side. At the front and rear sides of the cover 286A, inner partition plates 286B and 286C are respectively provided. An outer partition plate 286D is provided between the inner partition plate 286B of the front side and the front plate 281, and an outer partition plate 286E is provided between the partition plate 286C of the front side and the rear plate 282. By the inner partition plates 286B and 286C and the outer partition plates 286D and 286E, the inside of the intake box 28 is partitioned. The inner partition plates 286B and 286C are provided upright on the bottom plate 284, and the outer partition plates 286D and 286E are provided to be pendent from the top plate 283. Namely, the inner partition plates 286B and 286C and the outer partition plates 286D and 286E are arranged alternately longitudinally.

The outer partition plate 286D of the front side is arranged between the connection part of the right opening of the intake box 28 and the intake hose 27 (connection part C shown in FIG. 14) and the opening 281A (the external opening 413). The outer partition plate 286D of the front side is constructed by an inclination part 286Da facing the opening 281A aslant and a perpendicular part 286Db which is pendent from the lower end (end opposite to the connection part C) of the inclination part 286Da and faces the opening 281A frontally. The inclination part 286Da is inclined so that the distance to the opening 281A (distance L1 shown in FIG. 14) is longer at the lower side.

Sponge members 17 are stuck respectively to the surfaces of the outer partition plate 286D of the front side and the inner partition plate 286B facing each other, the surfaces of the outer partition plate 286E of the rear side and the inner partition plate 286C facing each other, and the upper and lower end surfaces of the cover 286A. Sponge members (not shown) as sound insulators are also stuck to the inner surfaces of the top plate 283, the bottom plate 284 and the left side plate 285.

According to the construction, air sucked from the external opening 413 at the front side of the cover body 41 flows into the intake box 28 through the opening 281A. Air from the opening 281A is divided into two, and one of the two passes below the outer partition plate 286D and then is sucked into the air cleaner 23 via the intake hose 27, and the other of the two runs above the inner partition plate 286B and is sucked into the engine cooling fan 25 via the opening 285A. As mentioned above, the inclination part 286Da is inclined so that the distance L1 to the front opening 281A is longer at the lower side, that is, the downstream side of the air flow, whereby the area of the passage through which air flows between the outer partition plate 286D and the inner surface of the front plate 281, and the air from the opening 281A flows smoothly. On the other hand, intake sound of the air cleaner 23 passes below the outer partition plate 286D and then leaks via the opening 281A through the external opening 413.

Air sucked from the external opening 415 at the rear side of the cover body 41 flows into the intake box 28 through the opening 282A. Then, air from the opening 282A runs below the outer partition plate 286E and above the inner partition plate 286C and is sucked into the engine cooling fan 25 via the opening 285A. Air sucked from the external opening 431 of the side lid 43 also flows into the intake box 28, and the air is sucked into the engine cooling fan 25 via the opening 285A. Accordingly, the air sucked from the external openings 413 and 415 is introduced into the engine cooling fan 25 by the intake box 28. Subsequently, the air sucked into the engine cooling fan 25 flows into the exhaust duct 15 through the right end opening of the exhaust duct 15, runs from the exhaust duct 15 to the muffler box 13, and is discharged outside the cover 4 through the external opening 421.

Figure 15:
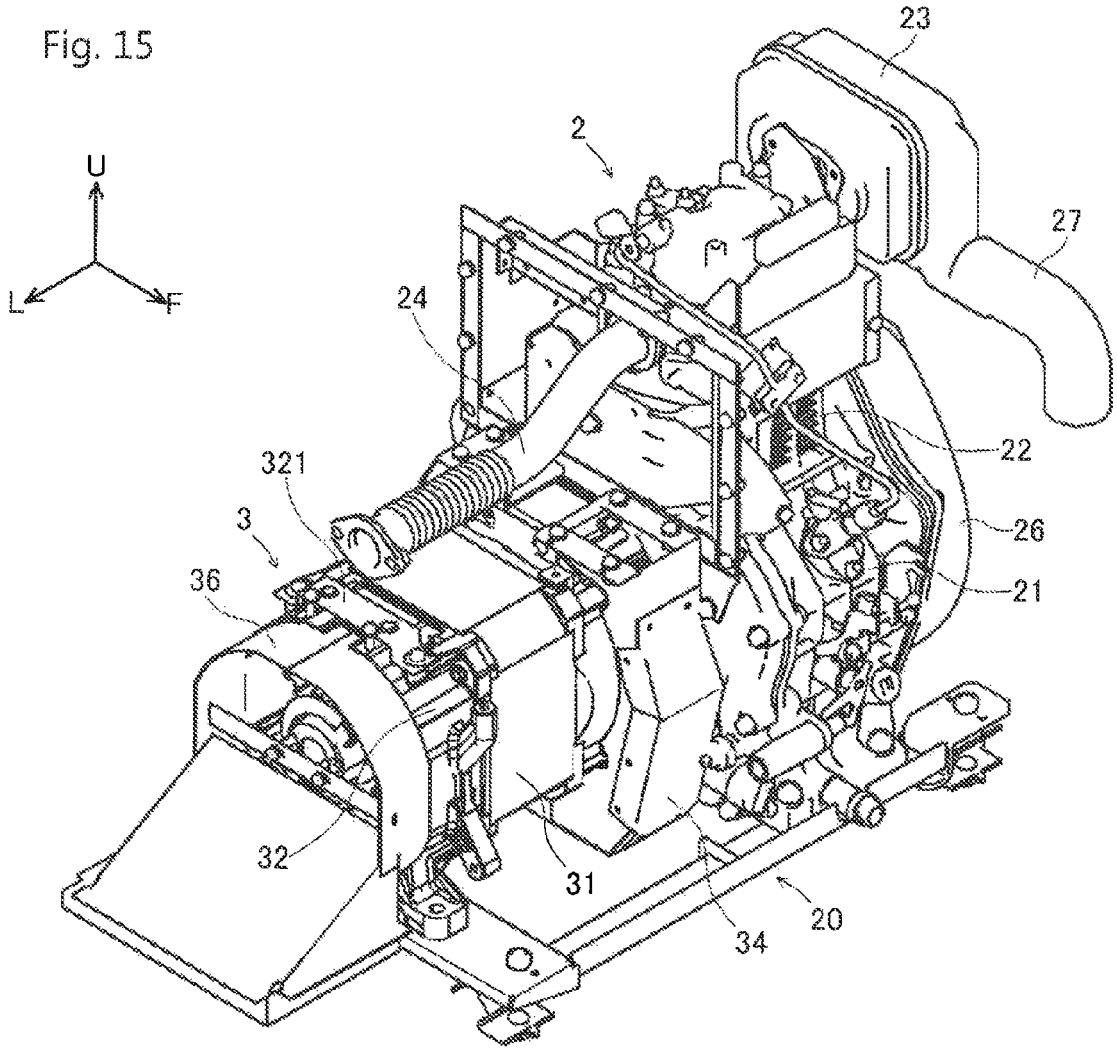
FIG. 15(*a*) is a perspective view showing the state in which the engine and the generator are fixed to a damper stay.
Figure 15:
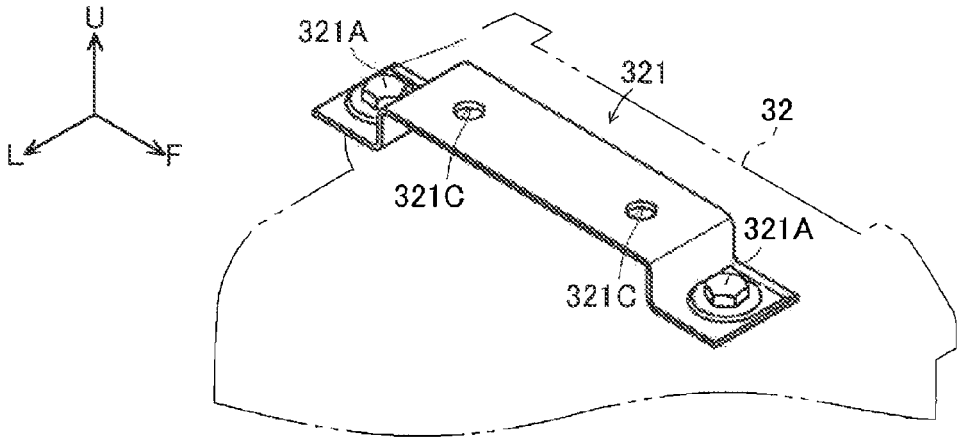
Figure 16:
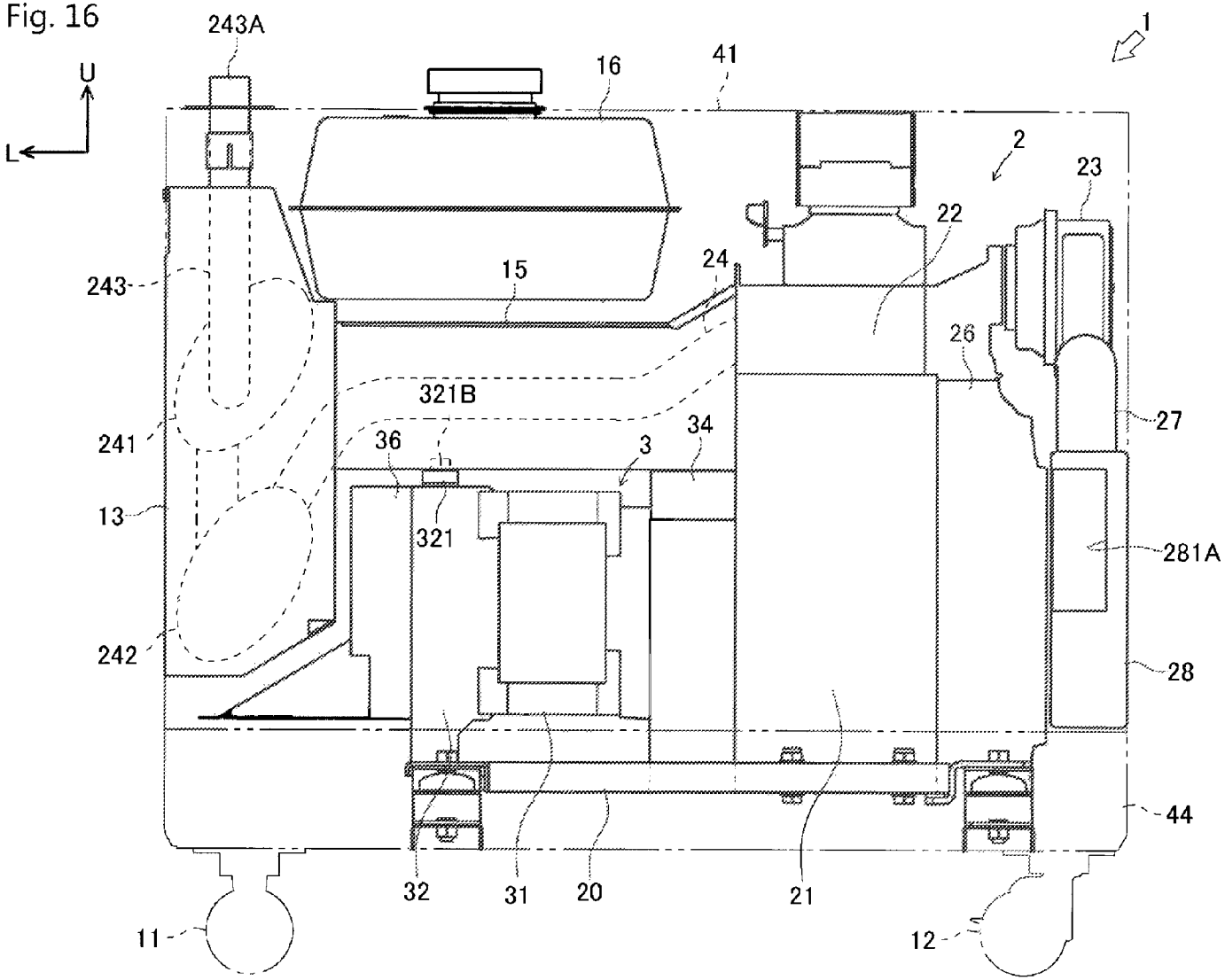
FIG. 16 is a front view of the engine and the generator fixed to the damper stay and an exhaust duct fixed to the attachment base.

Next, an explanation will be given on the attachment base 321 referring to FIGS. 15 and 16.

The attachment base 321 is a metal platy member, and front and rear ends thereof are formed substantially crank-like. At the front and rear ends of the attachment base 321, bolt holes (not shown) are formed through which two bolts 321A are inserted, and the attachment base 321 is attached to the generator rear bracket 32 by the bolts 321A. Between the front and rear ends of the attachment base 321, two bolt holes 321C are formed through which two bolts 321B are inserted, and the exhaust duct 15 is fixed to the attachment base 321 by the bolts 321B.

The engine 2 and the generator 3 are fixed on a damper stay 20. The exhaust duct 15 is fixed via the attachment base 321 to the generator 3 (the generator rear bracket 32) and is also fixed to the engine 2. Accordingly, the exhaust duct 15, the engine 2, the generator 3 and the damper stay 20 are constructed integrally so as to improve the rigidity thereof.

In this embodiment, the attachment base 321 is provided independently from the generator rear bracket 32 (bracket). However, the attachment base may alternatively be provided integrally with the bracket.

Next, an explanation will be given on the generator exhaust duct 34 referring to FIGS. 17 to 19. Thick black arrows in FIG. 18(*b*) show an air flow.

Figure 17:
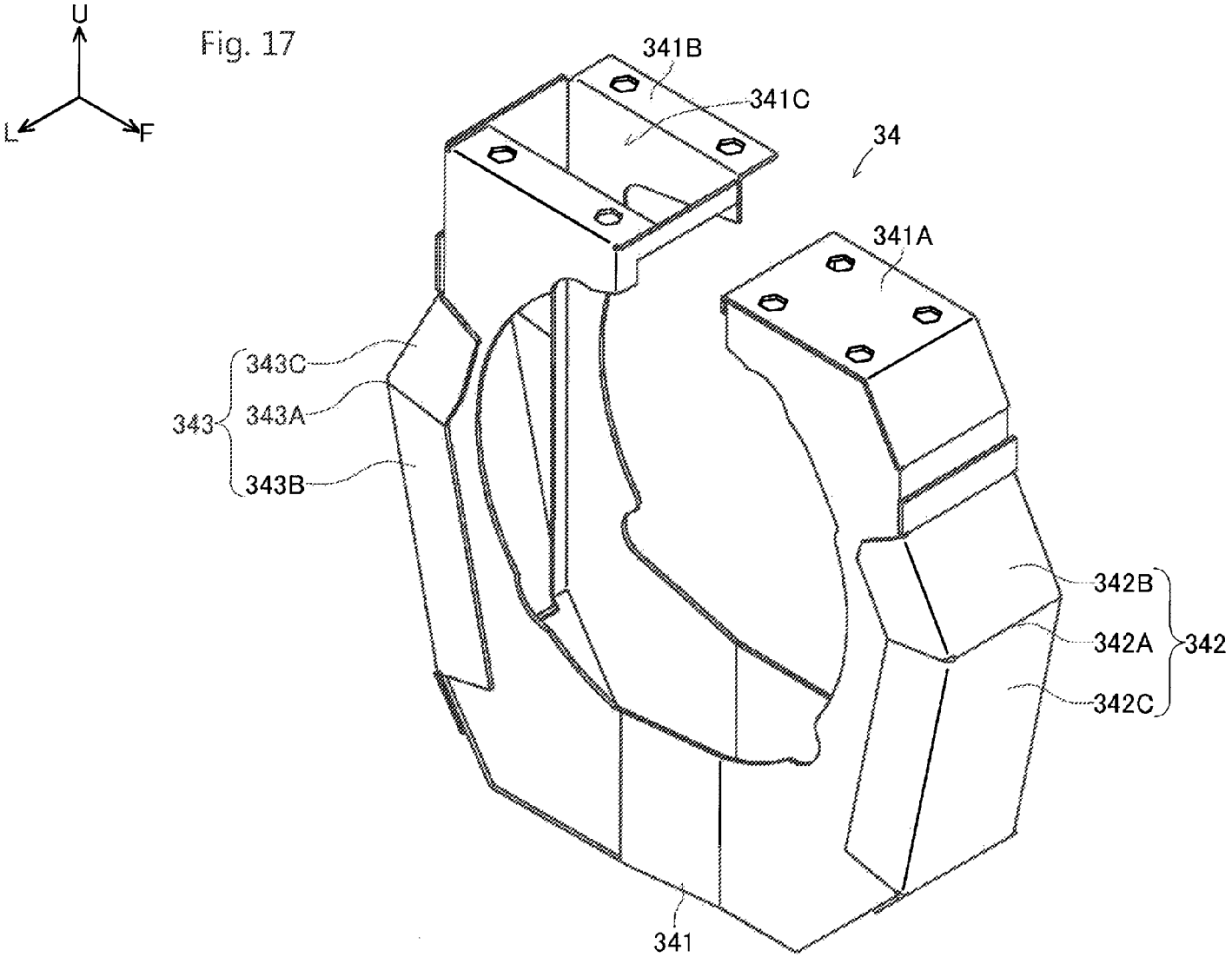
FIG. 17 is a perspective view of a generator exhaust duct.
Figure 18:
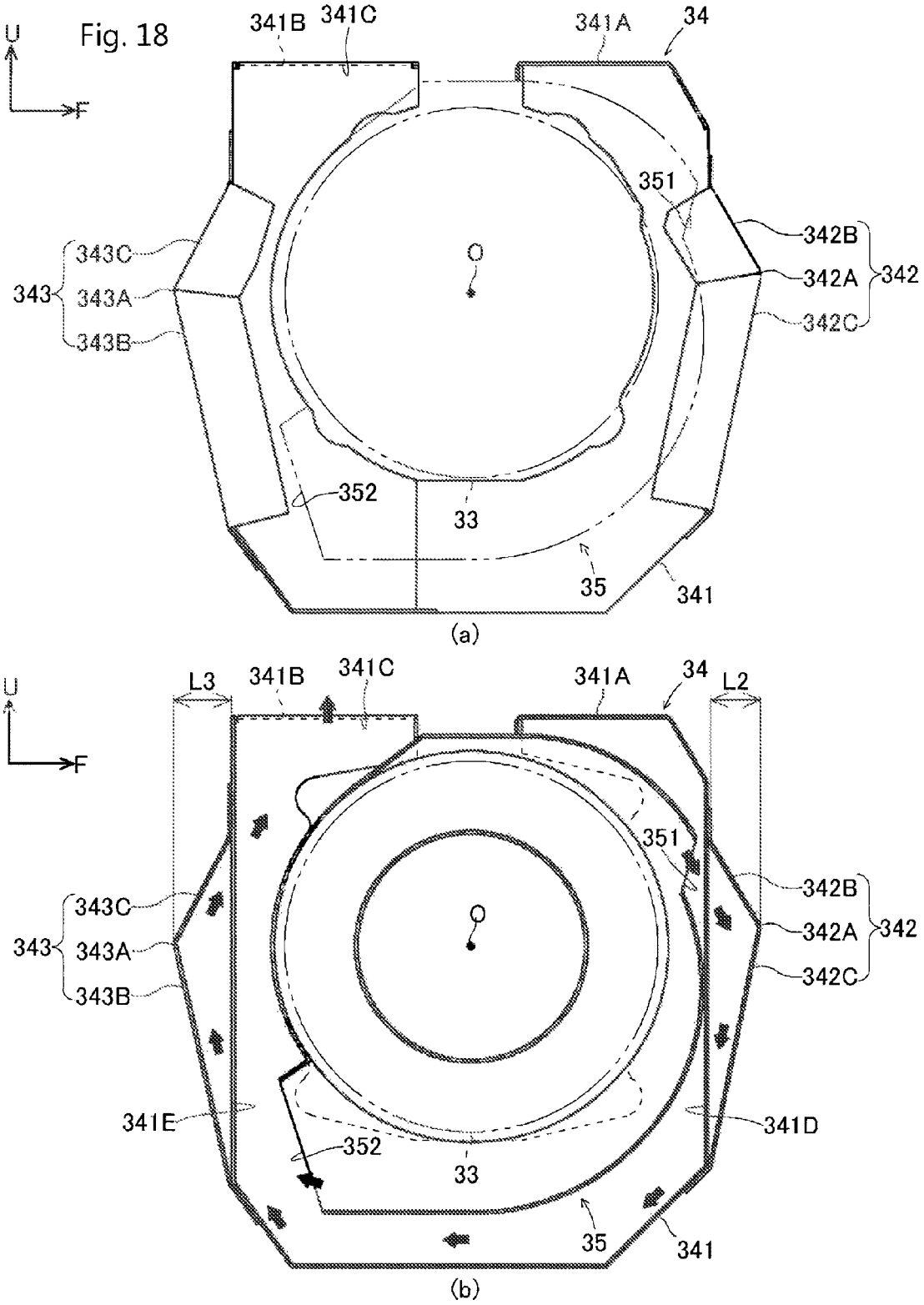
FIG. 18(*a*) is a side view of the generator exhaust duct.
Figure 19:
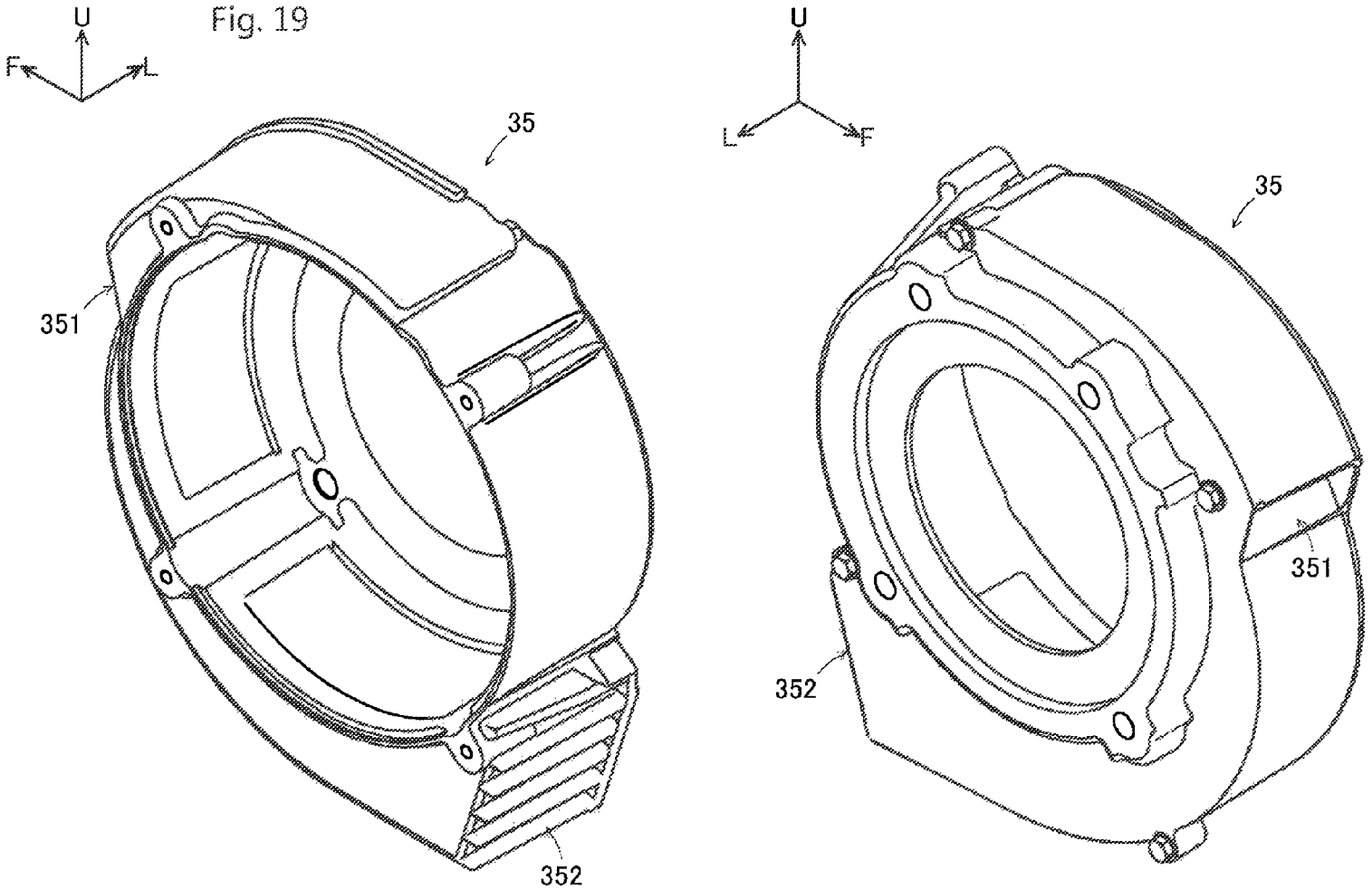
FIG. 19(*a*) is a perspective front view of a generator front bracket.

As shown in FIGS. 17 and 18, the generator exhaust duct 34 covers the circular perimeters of the generator cooling fan 33 and a generator front bracket 35, and air runs in the generator exhaust duct 34. In this embodiment, the generator cooling fan 33 rotates counterclockwise when viewed in left side (when the side of the engine 2 is seen from the side of the generator 3 in the lateral direction), and rotation direction of air in the generator exhaust duct 34 is counterclockwise.

The generator exhaust duct 34 has a duct body 341 which is opened upward so as to be U-like shaped. At the ends of the duct body 341 at the side of upstream of the rotation and the side of downstream of the rotation, attachment parts 341A and 341B are respectively provided which are attached to the lower surface of the exhaust duct 15. At the end of the duct body 341 at the side of downstream of the rotation, an opening 341C is provided. The opening 341C is connect to an opening (not shown) formed in the lower surface of the exhaust duct 15.

At the front and rear sides of the duct body 341, openings 341D and 341E are formed. The opening 341D of the front side is covered by a first expansion cover 342, and the opening 341E of the rear side is covered by a second expansion cover 343. The first and second expansion covers 342 and 343 expand outward in the rotational radial direction of the generator cooling fan 33.

In the generator exhaust duct 34, the generator cooling fan 33 is covered by the generator front bracket 35 having first and second exhaust ports 351 and 352. As shown in FIG. 19, the generator front bracket 35 is formed substantially scroll-like when viewed in side, and air runs in the generator front bracket 35 and is discharged through the first and second exhaust ports 351 and 352. The first exhaust port 351 is arranged above the rotation center of the generator cooling fan 33 (rotation center O shown in FIG. 18) at the front side of the generator front bracket 35, and the second exhaust port 352 is arranged below the rotation center O at the rear side of the generator front bracket 35. Air flows into the generator front bracket 35 through an opening (not shown) formed in the front side of the generator front bracket 35.

The first expansion cover 342 is bent at its middle portion (bent part 342A shown in FIG. 18) and is provided so as to face the first exhaust port 351. The bent part 342A at the middle portion of the first expansion cover 342 is the most front position of the first expansion cover 342, and the distance from the front surface of the duct body 341 to the bent part 342A is referred to as L2. The first expansion cover 342 is constructed by an upstream slanting part 342B arranged upstream the bent part 342A and a downstream slanting part 342C arranged downstream the bent part 342A. The upstream slanting part 342B is extended aslant toward the bent part 342A from the upper portion of the front surface of the duct body 341, and the downstream slanting part 342C is extended aslant toward the bent part 342A from the lower portion of the front surface of the duct body 341.

The second expansion cover 343 is bent at its middle portion (bent part 343A shown in FIG. 18) and is provided so as to face the second exhaust port 352. The bent part 343A at the middle portion of the second expansion cover 343 is the most rear position of the second expansion cover 343, and the distance from the rear surface of the duct body 341 to the bent part 343A is referred to as L3. In this embodiment, the distance L3 is longer than the distance L2. Namely, the second expansion cover 343 is expanded outward in the rotational radial direction of the generator cooling fan 33 more than the first expansion cover 342. The second expansion cover 343 is constructed by an upstream slanting part 343B arranged upstream the bent part 343A and a downstream slanting part 343C arranged downstream the bent part 343A. The upstream slanting part 343B is extended aslant toward the bent part 343A from the lower portion of the rear surface of the duct body 341, and the downstream slanting part 343C is extended aslant toward the bent part 343A from the upper portion of the rear surface of the duct body 341.

According to the construction, as shown in FIG. 18(*b*), air discharged from the first exhaust port 351 of the generator front bracket 35 runs smoothly along the upstream slanting part 342B of the first expansion cover 342, and the discharged air is changed its direction at the bent part 342A and runs smoothly along the downstream slanting part 342C. Air discharged from the second exhaust port 352 of the generator front bracket 35 runs smoothly along the upstream slanting part 343B of the second expansion cover 343, and the discharged air is changed its direction at the bent part 343A and runs smoothly along the downstream slanting part 343C. Accordingly, the air discharged from the first and second exhaust ports 351 and 352 joins each other and is discharged from the opening 341C of the generator exhaust duct 34. Subsequently, the air discharged from the opening 341C flows into the exhaust duct 15 via the above-mentioned opening in the lower surface of the exhaust duct 15, runs from the exhaust duct 15 to the muffler box 13, and is discharged outside the cover 4 through the external opening 421.

In this embodiment, the two first and second expansion covers 342 and 343 (expansion parts) are provided corresponding to the number of the first and second exhaust ports 351 and 352 of the generator front bracket 35 (bracket). However, one or three or more expansion parts may alternatively be provided corresponding to the number of the exhaust ports of the bracket. In this embodiment, the first and second expansion covers 342 and 343 (expansion parts) are provided independently from the duct body 341. However, the expansion parts alternatively be provided integrally with the duct body.

As mentioned above, the engine generator 1 having the engine 2, the generator 3 driven by the engine 2, the cover 4 covering the engine 2 and the generator 3, and the muffler box 13 in which the mufflers 241 and 242 of the engine 2 is housed, includes the external openings 412 and 414 formed in the cover 4 (the cover body 41) for sucking outside air into the cover 4, and intake ducts 7 for introducing the air sucked via the external openings 412 and 414 into the inside of the cover 4. The opening 71 is formed in the upper side of the intake duct 7, and the intake duct 7 is arranged along the side surface of the muffler box 13 and below the upper surface of the muffler box 13 for a predetermined distance. The sponge member 17 is provided between the upper side of the intake duct 7 and the side surface of the muffler box 13 so as to cover a part of the opening 71. The air passage 18 is formed above the intake duct 7 by the side surface of the muffler box 13 and the sponge member 17.

According to the construction, the attenuation length is extended by the air passage 18 so that the sound generated in the cover 4 is attenuated enough, thereby reducing the noise.

The cover 4 has the cover body 41 in which both sides thereof are opened and the pair of the side lids 42 and 43 covering the openings of both sides of the cover body 41. The ribs 416 are formed in the openings of both sides of the cover body 41. The muffler box 13 is fixed to the left rib 416 among the ribs 416.

According to the construction, the ribs 416 improves the rigidity of the cover body 41, and the cover body 41 and the muffler box 13 are constructed integrally so as to improve the rigidity thereof, thereby reducing the vibration of the cover body 41 so as to reduce the noise.

The engine cooling fan 25 is provided to the engine 2. The external openings 413 and 415 are provided which are formed in the cover 4 (the cover body 41) for sucking outside air into the cover 4. The intake box 28 is provided for introducing the air sucked via the external openings 413 and 415 into the engine cooling fan 25. The air cleaner 23 of the engine 2 is communicated through an intake hose 27 to the intake box 28.

According to the construction, the intake box 28 serves as an intake chamber, whereby it is not necessary to provide any intake chamber of exclusive use. Accordingly, by employing surplus space around the intake box 28 so as to increase the capacity of the intake box 28, the intake sound which causes the noise can be reduced. By omitting the intake chamber of exclusive use, the weight of the whole engine generator 1 can be reduced and the number of parts thereof can be reduced, whereby the cost can be reduced.

The intake box 28 is fixed to the left rib 416 among the ribs 416.

According to the construction, the cover body 41 and the intake box 28 are constructed integrally so as to improve the rigidity thereof, thereby reducing the vibration of the cover body 41 so as to reduce the noise.

The inside of the intake box 28 is partitioned by the outer partition plate 286D, and the partition plate 286D is arranged between the connection part C of the intake box 28 and the intake hose 27 and the external opening 413.

According to the construction, the attenuation length is extended by the outer partition plate 286D so that the intake sound is attenuated enough, thereby reducing the noise.

The exhaust duct 5 for discharging air in the cover 4 to the outside is provided above the generator 3. The attachment base 321 to which the exhaust duct 15 is attached is provided on the upper surface of the generator 3 (the generator rear bracket 32).

According to the construction, the exhaust duct 15 is attached to the attachment base 321 on the generator 3 (the generator rear bracket 32). Accordingly, the exhaust duct 15, the generator 3 and the engine 2 are constructed integrally so as to improve the rigidity thereof, thereby reducing the vibration of the exhaust duct 15 so as to reduce the noise.

The generator cooling fan 33 is provided to the generator 3. The generator cooling fan 33 is covered by the generator front bracket 35 having the first and second exhaust ports 351 and 352. The generator front bracket 35 is covered by the generator exhaust duct 34. The generator exhaust duct 34 is provided therein with the first and second expansion covers 342 and 343 which expands outward along the rotational radial direction of the generator cooling fan 33 and faces the first and second exhaust ports 351 and 352.

According to the construction, the first and second expansion covers 342 and 343 make the flowing of air in the vicinity of the first and second exhaust ports 351 and 352 smooth, thereby making the whole inside of the generator exhaust duct 34 smooth so as to cool efficiently the generator 3, in its turn the whole engine generator 1.

INDUSTRIAL APPLICABILITY

The present invention can be employed for an engine generator.

The invention claimed is:

1. An engine generator assembly comprising:
an engine;
a generator driven by the engine;
a cover covering the engine and the generator;
a muffler box in which a muffler of the engine is housed;
a first external opening formed in the cover for sucking outside air into the cover; and
an intake duct for introducing the air sucked via the first external opening into an inside of the cover,
wherein an opening is formed in an upper side of the intake duct, and the intake duct is arranged along a side surface of the muffler box and below an upper surface of the muffler box for a predetermined distance so that the opening at the upper side of the intake duct adjoins the side surface of the muffler box,
wherein a sound absorbing member is provided between the upper side of the intake duct and the side surface of the muffler box so as to cover a part of the opening, and
wherein an air passage is formed above the intake duct by the side surface of the muffler box and the sound absorbing member.

2. The engine generator assembly according to claim 1,
wherein the cover has a cover body in which both sides thereof are opened and a pair of side lids covering the openings of both sides of the cover body,
wherein a rib is formed in each of the openings of both sides of the cover body, and
wherein the muffler box is fixed to one of the ribs.

3. The engine generator assembly according to claim 2,
wherein an exhaust duct for discharging air in the cover to an outside of the cover is provided above the generator, and
wherein an attachment base to which the exhaust duct is attached is provided on an upper surface of the generator.

4. The engine generator assembly according to claim 2,
wherein a generator cooling fan is provided to the generator,
wherein the generator cooling fan is covered by a bracket having an exhaust port,
wherein the bracket is covered by a generator exhaust duct, and
wherein the generator exhaust duct is provided therein with an expansion part which expands outward along a rotational radial direction of the generator cooling fan and faces the exhaust port.

5. The engine generator assembly according to claim 2, further comprising:
an engine cooling fan provided to the engine;
a second external opening formed in the cover for sucking outside air into the cover; and
an intake box for introducing the air sucked via the second external opening into the engine cooling fan,
wherein an air cleaner of the engine is communicated through an intake hose to the intake box.

6. The engine generator assembly according to claim 5, wherein the intake box is fixed to another one of the ribs.

7. The engine generator assembly according to claim 1, further comprising:
an engine cooling fan provided to the engine;
a second external opening formed in the cover for sucking outside air into the cover; and
an intake box for introducing the air sucked via the second external opening into the engine cooling fan,
wherein an air cleaner of the engine is communicated through an intake hose to the intake box.

8. The engine generator assembly according to claim 7,
wherein an inside of the intake box is partitioned by a partition plate, and
wherein the partition plate is arranged between a connection part of the intake box and the intake hose and the second external opening.

9. The engine generator assembly according to claim 1, wherein an exhaust duct for discharging air in the cover to an outside of the cover is provided above the generator, and wherein an attachment base to which the exhaust duct is attached is provided on an upper surface of the generator.

10. The engine generator assembly according to claim 1, wherein a generator cooling fan is provided to the generator, wherein the generator cooling fan is covered by a bracket having an exhaust port, wherein the bracket is covered by a generator exhaust duct, and wherein the generator exhaust duct is provided therein with an expansion part which expands outward along a rotational radial direction of the generator cooling fan and faces the exhaust port.

* * * * *